US011583010B1

(12) United States Patent
Yarbrough et al.

(10) Patent No.: US 11,583,010 B1
(45) Date of Patent: Feb. 21, 2023

(54) BOUNCE-LIMITING UPPER BODY GARMENT

(71) Applicant: Spanx, LLC, Atlanta, GA (US)

(72) Inventors: Jadideah D. Yarbrough, Atlanta, GA (US); Sylma Colon-Otten, Atlanta, GA (US)

(73) Assignee: Spanx, LLC, Atlanta, GA (US)

( * ) Notice: Subject to any disclaimer, the term of this patent is extended or adjusted under 35 U.S.C. 154(b) by 635 days.

(21) Appl. No.: 16/162,100

(22) Filed: Oct. 16, 2018

Related U.S. Application Data

(60) Provisional application No. 62/572,811, filed on Oct. 16, 2017.

(51) Int. Cl.
*A41C 3/00* (2006.01)
*A41C 3/12* (2006.01)

(52) U.S. Cl.
CPC ..... *A41C 3/0021* (2013.01); *A41C 3/0057* (2013.01); *A41C 3/122* (2013.01)

(58) Field of Classification Search
CPC ..... A41C 3/0021; A41C 3/0057; A41C 3/06; A41C 3/0007; A41C 3/0014; A41C 3/04
USPC ..... 450/48, 45, 39, 60
See application file for complete search history.

(56) References Cited

U.S. PATENT DOCUMENTS 2,698,940 A * 1/1955 Dombek ..... A41C 3/142 450/39
2,776,433 A * 1/1957 Schaumer ..... A41C 3/06 450/48
2,826,202 A * 3/1958 Star ..... A41C 3/105 450/38
3,642,009 A * 2/1972 Nobbs ..... A41C 3/0021 450/60
6,298,527 B1 10/2001 Fildan et al.
D523,212 S 6/2006 Iourina
7,753,758 B1 * 7/2010 Arrington ..... A44B 11/04 450/89
9,192,197 B2 * 11/2015 Reinhard ..... A41C 3/02
9,756,880 B1 * 9/2017 Malik ..... A41C 3/04
D821,700 S 7/2018 Flower
RE47,667 E * 10/2019 De Sousa ..... A41C 3/10
2002/0002023 A1 * 1/2002 Nakanishi ..... A41C 3/142 450/66

(Continued)

OTHER PUBLICATIONS

Sports Insight, https://www.sports-insight.co.uk/trends-features/need-a-bit-more-support-then-cut-out-the-bounce-with-booband, Published Jul. 20, 2017.

(Continued)

*Primary Examiner* — Alissa J Tompkins
*Assistant Examiner* — Brieanna Szafran
(74) *Attorney, Agent, or Firm* — Meunier Carlin & Curfman LLC

(57) ABSTRACT

Various implementations include a bounce-limiting upper body garment, such as a brassiere (or bra), and methods of making the same. The bounce-limiting garment prevents breast tissue of a wearer from moving upwardly and side to side, which prevents bouncing of the breast tissue. The upward movement of the breast tissue is prevented by applying pressure by the garment on or just above the upper breast tissue, and the side to side movement of the breast tissue is prevented by applying pressure by the garment along lateral sides of the breasts.

17 Claims, 15 Drawing Sheets

(56) References Cited

U.S. PATENT DOCUMENTS

| | | | | |
|---|---|---|---|---|
| 2003/0003844 | A1* | 1/2003 | Jones | A41C 3/00 450/88 |
| 2006/0252346 | A1* | 11/2006 | Reinisch | A41C 3/0028 450/86 |
| 2010/0223713 | A1* | 9/2010 | De Sousa | A41C 3/08 2/244 |
| 2013/0065486 | A1* | 3/2013 | Hansen | A41C 3/0064 450/59 |
| 2013/0225045 | A1 | 8/2013 | Dandapure et al. | |
| 2015/0099420 | A1* | 4/2015 | Reinhard | A41C 3/02 450/58 |

OTHER PUBLICATIONS

Nike, Nike Dri Fit, Mar. 11, 2009.
Notice of Allowance issued for U.S. Appl. No. 29/666,831, dated Aug. 8, 2019.
Bravissimo, Beat the Bounce and Go for It. bravissimo.com/us. Jan. 1, 2019.

* cited by examiner

BOUNCE-LIMITING UPPER BODY GARMENT

CROSS REFERENCE TO RELATED APPLICATIONS

This application claims priority to U.S. Patent Application No. 62/572,811, filed Oct. 16, 2017, and entitled "Limited-Bounce Brassiere and Methods of Making the Same," the content of which is herein incorporated by reference in its entirety. Further, this application is related to U.S. application Ser. No. 29/666,831, filed Oct. 16, 2018, and entitled "Upper Body Garment," the content of which is herein incorporated by reference in its entirety.

BACKGROUND

During exercise, the breasts move in three planes of motion: vertically, horizontally, and laterally, in an overall figure-8 motion. Many women report some pain or discomfort in their breasts during physical activity, some to the extent that exercise is unbearable. In addition to pain, unrestrained movement causes stretching of the Cooper's ligaments, the small bands of connective tissue attached through and around the breast tissue that connect to surrounding chest muscles. This stretching of the Cooper's ligaments contributes to breast sagging over time.

Upper body garments that limit bouncing of the breast tissue provide women with increased comfort during physical activity and limit sagging. Sometimes called sports bras, these upper body garments are made of more compressive materials than standard brassieres. This technology is not necessarily limited to brassieres. Full length upper body garments have also been designed with additional compression of the chest to reduce bouncing during physical activity. Generally, these garments have been designed to compress the breasts from all directions. While conventional technologies offer some added benefit during exercise, the breasts are still able to move in three planes of motion. New technology to further reduce movement of the breast tissue during exercise will limit sagging, reduce pain, and generally encourage greater physical activity.

BRIEF SUMMARY

A bounce-limiting upper body garment, such as a brassiere (or bra), is disclosed herein. The bounce-limiting garment prevents breast tissue of a wearer from moving upwardly and side to side, which prevents bouncing of the breast tissue. The upward movement of the breast tissue is prevented by applying pressure by the garment on or just above the upper breast tissue, and the side to side movement of the breast tissue is prevented by applying pressure by the garment along lateral sides of the breasts.

The bounce-limiting upper body garment includes an inner layer and an outer layer that is separately formed from the inner layer. The inner layer includes a laterally extending central region that extends across a wearer's breasts and a band that extends inferiorly from the laterally extending central region. The band extends laterally around the wearer's chest and back. The outer layer includes laterally extending top portion that extends across at least part of the superior portion of the wearer's breasts. A right side extension extends inferiorly from the right portion of the top portion of the outer layer. A left side extension extends inferiorly from the left portion of the top portion of the outer layer. Some embodiments also include a middle extension that extends inferiorly from the central portion of the top portion of the outer layer. The outer layer can be attached over a portion of an outer side of the inner layer such that, when attached, the top portion of the outer layer is positioned over at least a portion of the central region of the inner layer, and an inner side of the top portion faces the outer side of the inner layer. In some embodiments, the narrowest height of the top portion of the outer layer is narrower than the narrowest height of the central region of the inner layer (top portion height being measured in a superior-inferior direction at a narrowest region located between the right and left side extensions).

The upper body garment also includes at least one stiffener that is coupled to and extends laterally along at least part of the top portion of the outer layer. The stiffener is less elastic than a material of the outer layer. During wear, the stiffener or stiffeners are disposed against part of a superior portion of one or both of the wearer's breasts. In some embodiments, right and left stiffeners are included. Each of the right and left stiffeners has an arcuate shape with an apex, a lateral end, and a medial end. The apex of the stiffener is disposed superiorly from the lateral and medial ends. The apex of each of the right and left stiffeners lies in a first horizontal plane that is parallel to the wearer's sagittal plane. The right and left apices also lie in first right and left vertical planes that are parallel to the wearer's frontal plane and to each other. The lateral ends of each of the right and left stiffeners lie in a second horizontal plane that is parallel to and spaced apart from the first horizontal plane. The right and left lateral ends also lie in second right and left vertical planes that are parallel to and spaced apart from the first right and left vertical planes. The medial ends of each of the right and left stiffeners lie in a third horizontal plane that is parallel to and spaced apart from the first horizontal plane. The right and left medial ends also lie in third right and left vertical planes that are parallel to and spaced apart from the first right and left vertical planes.

The central region of the inner layer can include a right cup and a left cup for receiving the breasts of the wearer. When the outer layer is attached to the inner layer, the right stiffener can be positioned over an upper portion of the right cup and a left stiffener can be positioned over an upper portion of the left cup. In some embodiments, the stiffener can be encased in a material that is attached to and extends laterally along at least a portion of the top portion of the outer layer. For example, the material can be a foamed material that is coupled to the inner side of the outer layer.

In some embodiments, the central region of the inner layer defines an opening disposed between the right and left cups. The opening lies below a plane that includes an apex of each of the right and left cups. The garment further comprises a loop having an inner portion that is coupled to an inner side of the inner layer at a position adjacent to the opening and an outer portion. The loop extends through the opening such that the outer portion is adjacent an outer side of the inner layer. An inferior end portion of the middle extension is extendable through the outer portion of the loop and is attachable to an intermediate portion of the middle extension. For example, the inferior end portion of the middle extension can include a first middle extension fastener that is removably attachable to a second middle extension fastener positioned on an intermediate portion of the middle extension. The first and second middle extension fasteners can be coupled to the outer side of the middle extension.

The outer layer can be removably attachable over a portion of the outer side of the inner layer. For example, the outer layer can include right and left shoulder strap extensions that extend superiorly from the right and left portions of the laterally extending top portion. The outer layer can further include right and left outer layer shoulder strap fasteners that removably attach to corresponding right and left inner layer shoulder strap fasteners attached to the inner layer. The outer layer also includes right and left side extensions. The right and left side extensions include right and left side extension fasteners for removably attaching the right and left side extensions to the inner layer.

In some embodiments, right and left shoulder straps extend superiorly from the central region of the inner layer. The right and left shoulder straps are coupled to a posterior side of the inner layer. In some embodiments, the right and left shoulder straps can cross over each other on the posterior side. In some embodiments, the garment includes a posterior shoulder strap coupler that couples the right and left shoulder straps to each other and to the shoulder strap coupler. The shoulder strap coupler can be positioned superiorly to a posterior side of the band that extends around the wearer's chest and back. The band can include a first posterior end coupled to a first back fastener and a second posterior end coupled to a second back fastener. The back fasteners are attachable together. The first posterior end and the first back fastener can be coupled to each other by a first elastic material that extends between them. Likewise, the second posterior end and the second back fastener can be coupled by a second elastic material that extends between them. The first and second elastic materials have an elasticity that is greater than an elasticity of the band.

BRIEF DESCRIPTION OF THE DRAWINGS

The device is explained in even greater detail in the following drawings. The drawings are merely exemplary to illustrate the structure of garments and certain features that may be used singularly or in combination with other features. The drawings are not necessarily drawn to scale.

DETAILED DESCRIPTION

Figure 1A:
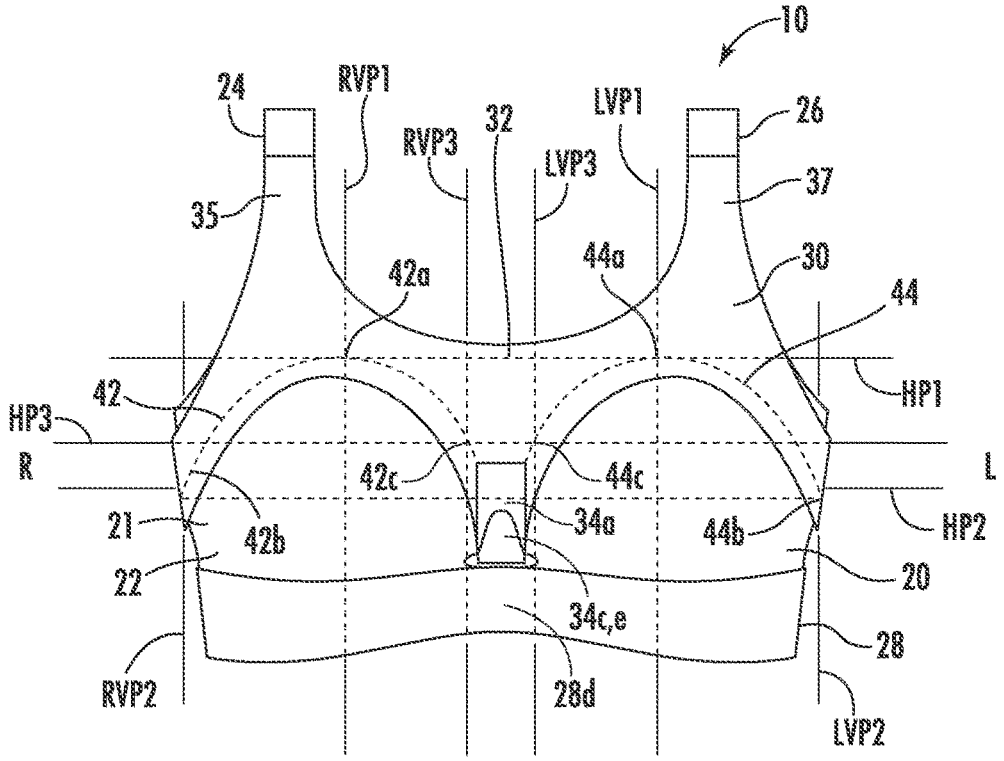
FIG. 1A illustrates a plan view of an outer side of an anterior, or front, side an upper body garment according to one implementation.

Various implementations include a bounce-limiting upper body garment, such as a brassiere (or bra), and methods of making the same. The bounce-limiting garment prevents breast tissue of a wearer from moving upwardly and side to side, which prevents bouncing of the breast tissue. The upward movement of the breast tissue is prevented by applying pressure by the garment on or just above the upper breast tissue, and the side to side movement of the breast tissue is prevented by applying pressure by the garment along lateral sides of the breasts.

According to some implementations, the bounce-limiting garment includes an inner layer and an outer layer. When the outer layer is attached to the inner layer and extends over at least a portion of the upper breast tissue, the outer layer applies pressure around at least an upper portion and lateral side portions of the contour of the base of each breast to prevent movement of the breasts. For example, the outer layer may include one or more stiffeners that extend over and around upper portions of the breasts. Each stiffener includes a stiff portion that does not stretch along the longitudinal axis thereof (or has a limited ability to stretch in the axial direction) but is flexible about the axis to extend along and against a portion of the base of each breast. Attaching the outer layer securely against the inner layer and the wearer's body holds the stiffener against the wearer's body and prevents upward and side to side movement of the breasts. In addition, in further implementations, the inner layer encapsulates each breast in a cup and provides additional pressure around the lower portions of the base of each breast to lift and further support the breast tissue. And, the outer layer may be removably attached to allow the outer layer to be unattached when the additional support provided by the outer layer is not needed. In addition, in some implementations, the amount of pressure applied by the outer layer to the wearer's body may be adjustable for different activities, sizing, or comfort level of the wearer. Various implementations of bounce-limiting upper body garments are described below in relation to FIGS. 1A-25.

The description below refers to certain aspects of the garment relative to other aspects of the garment or to the body of a wearer. The claims do not include the wearer, but some features of the garment may include names that refer to body parts of the wearer adjacent which the features are intended to be disposed when the garment is worn. As used herein, superior indicates a direction that is closer to the wearer's head. Inferior indicates a direction that is closer to the wearer's feet. Upward, upper, or uppermost indicates a superior direction, or toward a wearer's head. Downward, lower, or lowermost indicates an inferior direction, or toward a wearer's feet. The longitudinal direction refers to an axis extending between the superior and inferior edges of the garment, or between the wearer's head and feet. Lateral indicates a positioning that is closer to the sides of the wearer. Medial indicates a positioning that is farther from the sides of the wearer. Anterior indicates a positioning closer to the front of a wearer. Posterior indicates a positioning closer to the back of a wearer. The terms right and left refer to directions from the wearer's perspective. Some of the figures may include the letters R and L as right and left directional indicators, respectively.

For example, FIG. 1A illustrates a front view of a bounce-limiting bra 10 for limiting upward movement of a wearer's breasts according to one implementation. The upper body garment 10 includes an inner layer 20 and an outer layer 30.

Figure 3:
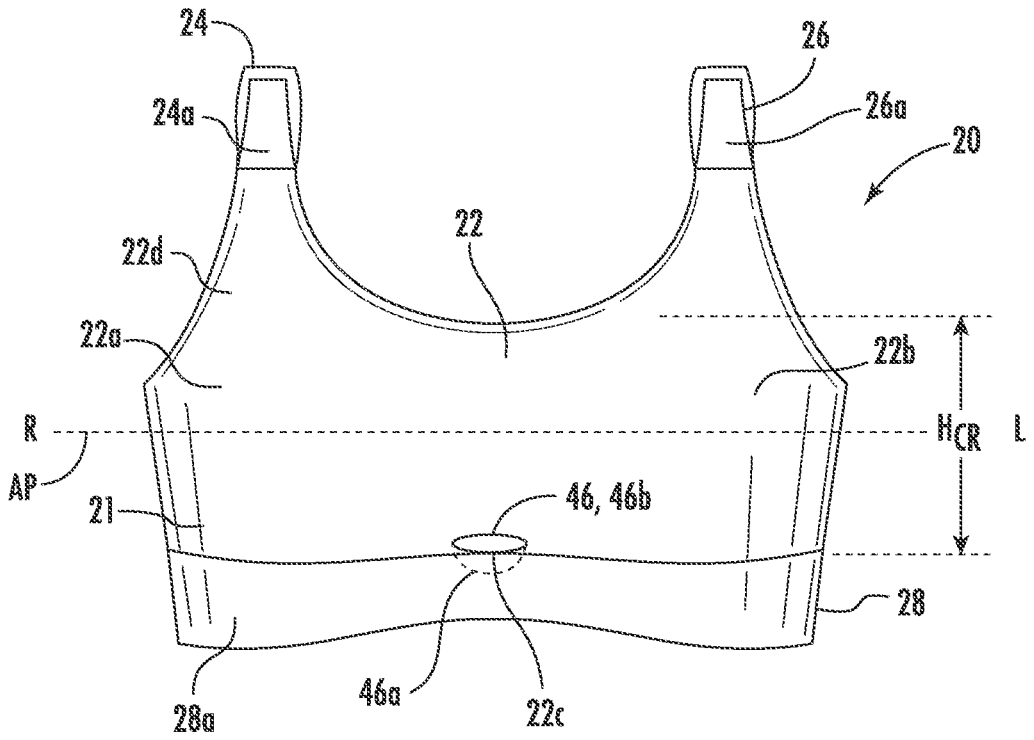
FIG. 3 illustrates a plan view of the outer side of the front side of an inner layer of the upper body garment shown in FIGS. 1A-1C.

A front view of the outer side of the inner layer 20 is shown in FIG. 3 without outer layer 30. The inner layer 20 includes a laterally extending front central region 22 that extends across a wearer's breasts when worn, a right shoulder strap 24 that extends superiorly from the front central region 22, a left shoulder strap 26 that extends superiorly from the front central region 22, and a band 28 that extends around torso of the wearer when worn. A front portion 28*a* of the band 28 extends inferiorly from the laterally extending front central region 22 and is disposed below the wearer's breasts. The right and left shoulder straps 24, 26 may include padding to prevent discomfort to the wearer, and the length of each shoulder strap 24, 26 (the length being measured between the central region 22 and the back regions 63*a*, 63*b* over the shoulder of the wearer) may be adjustable. In some implementations, the padding is 5 to 10 mm thick.

Figure 4:
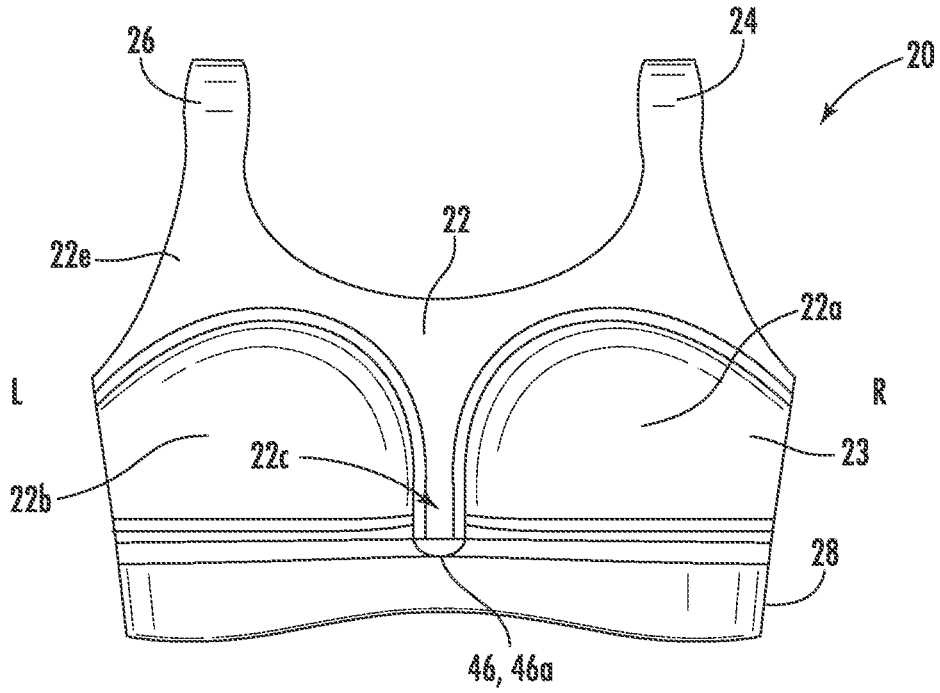
FIG. 4 illustrates a plan view of the inner side of the front side of the inner layer of the upper body garment shown in FIGS. 1A-1C.

A plan view of the inner side of the front side of the inner layer is shown in FIG. 4. The front central region 22 includes a right cup 22*a* for receiving the right breast of the wearer, a left cup 22*b* for receiving the left breast of the wearer, an outer material 22*d*, and an inner upper material 22*e*. The outer material 22*d* covers the anterior side of the wearer to provide a smooth look for the inner layer 20. The inner upper material 22*e* is M-shaped and is coupled to an inner side of the outer material 22*d* adjacent an upper edge of the outer material 22*d* (e.g., bonded and/or via a seam around a perimeter of the inner upper material 22*e*). The cups 22*a*, 22*b* are coupled to a lower edge of the M-shaped inner upper material 22*e* and the outer material 22*d* (e.g., bonded and/or via a seam around each cup 22*a*, 22*b*). The M-shaped inner upper material 22*e* and the cups 22*a*, 22*b* encapsulate and separate the breasts. Right shoulder strap 24 and left shoulder strap 26 are coupled to right and left portions, respectively, of the coupled outer material 22*d* and inner upper material 22*e* and extend superiorly therefrom. A lower portion of the outer layer 22*d* extends between the cups 22*a*, 22*b* and the band 28.

In some implementations, the right 22*a* and left cups 22*b* are padded cups to provide support for the breast tissue and/or to prevent the nipples from showing on the outer side 21 of the inner layer 20. In further or alternative implementations, the cups 22*a*, 22*b* are made of a wickable and/or breathable material. In addition, in further or alternative implementations, each cup 22*a*, 22*b* may include a side slimming portion that extends around each side of the wearer when worn. For example, each cup 22*a*, 22*b* extends around each side of the wearer or under the arm of the wearer, which compresses such areas of the wearer to provide a slimmer profile. In other implementations, cups 22*a*, 22*b* have a thickness of about 2 mm. For example, cups 22*a*, 22*b* have a thickness of 1 mm, 2 mm, 3 mm, 4 mm, 5 mm, or another other thickness, including therebetween the aforementioned ranges, that will sufficiently provide an appropriate thickness.

The outer material 22*d* of the inner layer 20 also extends around to a posterior side of the wearer when worn. As shown in the back view of the garment 10 of FIG. 2A, a back central portion 63 of the outer material 22*d* fits against the wearer's back when worn. The back central portion 63 comprises a right back central portion 63*a* and a left back central portion 63*b*. The back central portions 63*a*, 63*b* are coupled to the band 28. Medial edges of at least a portion of each back central portion 63*a*, 63*b* are spaced apart from each other to form a gap in the center of the wearer's back, which facilitates taking the garment on and off. The right shoulder strap 24 is coupled to the right back central portion 63*a*, and the left shoulder strap 26 is coupled to the left back central portion 63*b*. Seams on inner sides of the inner layer 20 may be made using hot melt construction to avoid chafing, binding, or pinching.

Figure 2A:
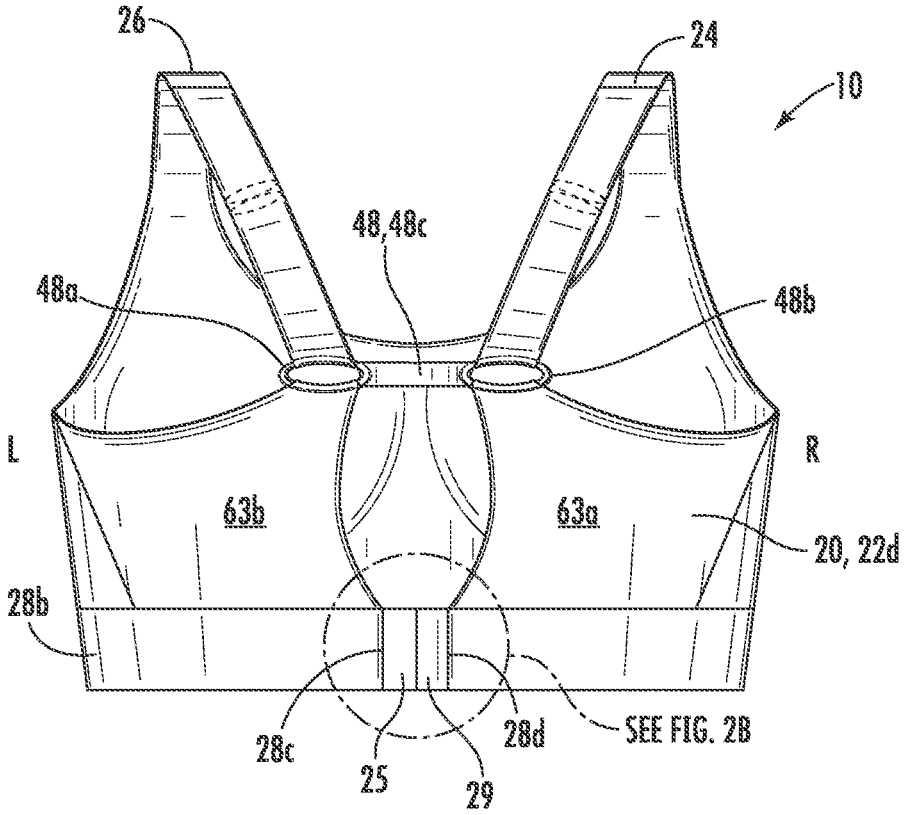
FIG. 2A illustrates a plan view of the outer side of a posterior, or back, side of the upper body garment shown in FIGS. 1A-1C.

Referring still to FIG. 2A, the garment 10 also includes a posterior shoulder strap coupler 48 that couples the right 24 and left shoulder straps 26 to each other and to the shoulder strap coupler 48. The posterior shoulder strap coupler 48 is disposed superiorly relative to the posterior portion 28*b* of the band 28 and portions of the right and left back central portions 63*a*, 63*b* to which the shoulder straps 24, 26, respectively, are coupled. The coupler 48 prevents the shoulder straps 24, 26 from shifting laterally across the wearer's back and causes the front central region 22 to apply additional pressure to the breasts, which provides additional support for the breasts by maintaining the pressure applied to the breasts by the inner layer 20.

The posterior shoulder strap coupler 48 includes a left ring 48*a*, a right ring 48*b*, and a central portion 48*c* that extends between and couples the left and right rings 48*a*, 48*b*. An axis of the central portion 48*c* extends through the rings 48*a*, 48*b*. In some implementations, the rings 48*a*, 48*b* are formed from the same material as the central portion 48*c*, and in other implementations, the rings 48*a*, 48*b* are formed from a different material and are coupled with the central portion 48*c*. For example, the material(s) for the coupler 48 may include silicone, plastic, and/or metal. In some embodiments, the material for the coupler 48 may be a highly elastic fabric. For example, the coupler 48 may have a lower elastic modulus than the shoulder straps 24, 26 to which it connects.

A posterior portion of the right shoulder strap 24 extends through the right ring 48*b*, and a posterior portion of the left shoulder strap 26 extends through the left ring 48*a*. The central portion 48*c* maintains a distance between the right 24 and left shoulder straps 26 where the coupler 48 couples to the shoulder straps 24, 26, which provides additional support for the breasts by maintaining the pressure applied to the breasts by the inner layer 20.

In some implementations, a distal end portion of the posterior portion of the right shoulder strap extends through and is coupled to the right ring, and a superior portion of the right back central portion of the inner layer is also coupled to the right ring. In addition, a distal end portion of the posterior portion of the left shoulder strap extends through and is coupled to the left ring, and a superior portion of the left back central portion of the inner layer is also coupled to the left ring. In such an implementation, the rings couple the shoulder straps with the back central portions, prevent lateral movement of the straps across the wearer's back, and cause the front central region to apply additional pressure to the breasts by the inner layer.

In other implementations, such as the implementations shown in FIGS. 9-23, the garment may not include the posterior shoulder strap coupler. In the implementations shown in FIGS. 12 and 17, the posterior portions of the right and left shoulder straps 124, 126, 224, 226 cross over each other superiorly of where the straps 124, 126, 224, 226 are coupled to the left and right back central portions 163*a*, 163*b*, 263*a*, 263*b*, respectively. Crossing of the shoulder straps prevents the shoulder straps from shifting laterally across the wearer's back, which provides additional support for the breasts by maintaining the pressure applied to the breasts by the inner layer 20. And, in some implementations, the back central portion may not include two or more portions.

Figure 2B:
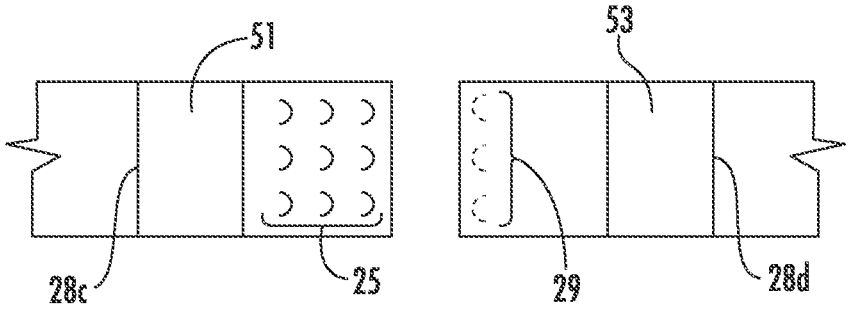
FIG. 2B is a close up of the circled portion in FIG. 2A.

In addition, the posterior portion 28*b* of the band 28 includes a first posterior end 28*c* and a second posterior end 28*d*, as shown in FIG. 2B. The first posterior end 28*c* of the band 28 is coupled to a first back fastener 25, and the second posterior end 28*d* of the band 28 is coupled to a second back fastener 29. The back fasteners 25, 29 are attachable together to secure the band 28 around the torso of the wearer.

The back fasteners could comprise any of a known variety of fasteners, including, but not limited to hook and loop fasteners (such as Velcro®), snaps, ribbon ties, zippers, buttons, and/or one or more slidable hook fasteners. A slidable hook fastener includes a slidable hook that lays generally flat against the wearer's body. The slidable hook can attach to an elongated eye or channel, or in some embodiments, to another slidable hook fastener. As shown in FIG. 2B, the back fasteners 25, 29 include slidable hooks and loops for receiving the slidable hooks (also referred to as hook and eye closures).

The first posterior end 28*c* of the band 28 and a material to which the first back fastener 25 is directly coupled are coupled by a first elastic material 51 extending therebetween. And, the second posterior end 28*d* and a material to which the second back fastener 29 is directly coupled are coupled by a second elastic material 53 extending therebetween. The first 51 and second elastic materials 53 have an elasticity that is greater than an elasticity of the band 28. However, in other implementations, the first and second elastic materials 51, 53 may not be included, and each material to which the first and second back fasteners 25, 29 are directly coupled is directly coupled to the ends 28*b*, 28*c* of the band 28, respectively. Similarly configured back adjusters are described in U.S. patent application Ser. No. 15/965,019, which is hereby incorporated by reference in its entirety.

Figure 5:
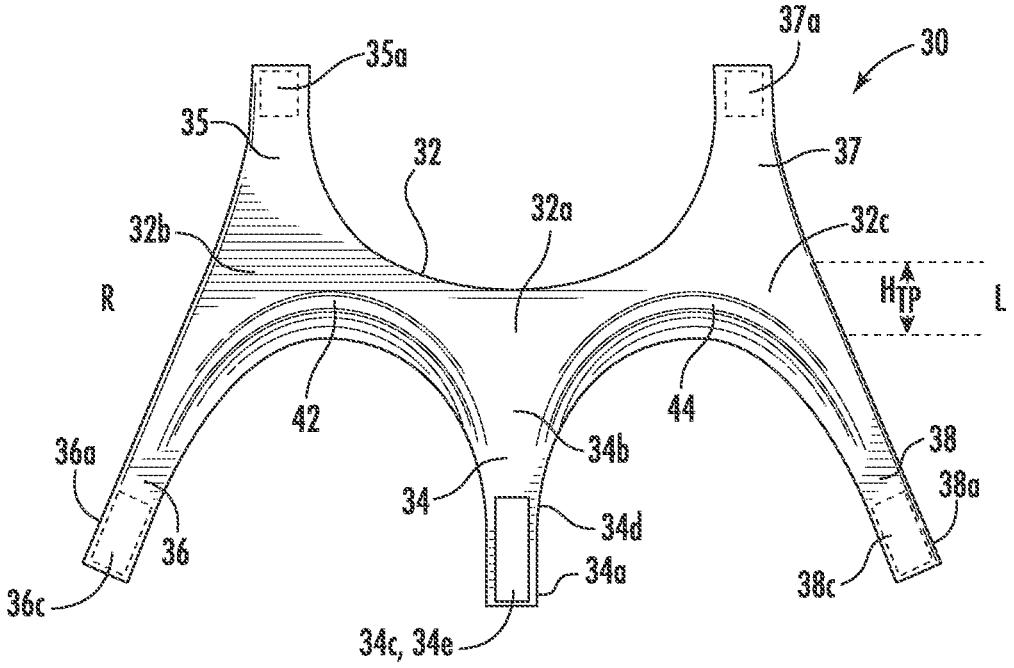
FIG. 5 illustrates a plan view of the outer side of the outer layer of the upper body garment shown in FIGS. 1A-1C.

FIG. 5 shows a front view of the outer layer 30 without the inner layer 20. Outer layer 30 has a laterally extending top portion 32 that extends across at least a superior portion of the wearer's breasts when worn, a middle extension 34 extending inferiorly from a central portion 32*a* of the top portion 32, a right side extension 36 extending inferiorly from a right portion 32*b* of the top portion 32, a left side extension 38 extending inferiorly from a left portion 32*c* of the top portion 32, a right shoulder strap extension 35 that extends superiorly of the right portion 32*b* of the top portion 32, and a left shoulder strap extension 37 that extends superiorly of the left portion 32*c* of the top portion 32. In other words, as shown in FIG. 5, the outer layer 30 has an upper edge that partially defines a laterally extending top portion 32 of the outer layer 30. The upper edge extends continuously from a right side of the outer layer 30 to a left side of the outer layer 30. The outer layer 30 also has a lower edge that is removed from the upper edge and positioned inferiorly to the upper edge. The lower edge at least partially defines a right extension 36 that extends inferiorly from a right side of a top portion 32 of the outer layer 30, a left extension 38 that extends inferiorly from a left side of the top portion 32, and a middle extension 34 that extends inferiorly from a central portion 32*a* of the top portion 32. The top portion 32 and the right 36, left 38, and middle extensions 34 of the outer layer 30 form an M-shape. In the implementation shown, a height $H_{TP}$ of the top portion 32 of the outer layer 30, as measured in a superior-inferior direction at a narrowest region of the top portion 32 between the right 36 and left side extensions 38 (labeled in FIG. 5), is narrower than a height HCR of the front central region 22 of the inner layer 20 at a narrowest region of the central region 22 (labeled in FIG. 3). However, in other implementations, the height of the top portion may be equal to or greater than the height of the front central region of the inner layer.

The outer layer 30 is separately formed from the inner layer 20 and is removably attachable over a portion of an outer side 21 of the inner layer 20 such that, when attached, the top portion 32 of the outer layer 30 is disposed over at least a portion of the front central region 22 of the inner layer 20, and an inner side of the top portion 32 faces the outer side 21 of the inner layer 20. However, in some implementations (not shown), at least a portion of the outer layer 30 may be fixedly attached to at least a portion of the inner layer 20.

As shown in FIG. 5, a right outer layer shoulder strap fastener 35*a* is coupled to the right shoulder strap extension 35 and a left outer layer shoulder strap fastener 37*a* is coupled to the left shoulder strap extension 37. Similarly, as shown in FIG. 3, a right inner layer shoulder strap fastener 24*a* is coupled to the right shoulder strap 24, and a left inner layer shoulder strap fastener 26*a* is coupled to the left shoulder strap 26. The outer layer shoulder strap fasteners 35*a*, 37*a* removably attach to the corresponding right and left inner layer shoulder strap fasteners 24*a*, 26*a*. Furthermore, the outer and inner layer shoulder strap fasteners 35*a*, 37*a*, 24*a*, and 26*a* could comprise any of a known variety of fasteners, including, but not limited to hook and loop fasteners (such as Velcro®), snaps, ribbon ties, zippers, buttons, and/or one or more slidable hook fasteners. A slidable hook fastener includes a slidable hook that lays generally flat against the wearer's body. The slidable hook can attach to an elongated eye (or channel) or, in some embodiments, to another slidable hook fastener. In the implementation shown in FIGS. 1, 3, 5, and 6, the fasteners 35*a*, 37*a*, 24*a*, 26*a* include hook and loop fasteners. However, in the implementation shown in FIGS. 9, 13, 14, and 15, the fasteners 135*a*, 137*a*, 235*a*, 237*a* are hooks, and the fasteners 124*a*, 126*a*, 224*a*, 226*a* include a plurality of elongated eyes that define horizontally extending channels that are vertically oriented relative to each other for receiving the respective hook 135*a*, 137*a*, 235*a*, 237*a*. It should be understood that any suitable fastener may be used to couple the shoulder strap extensions of the outer layer to the shoulder straps of the inner layer.

Figure 1B:
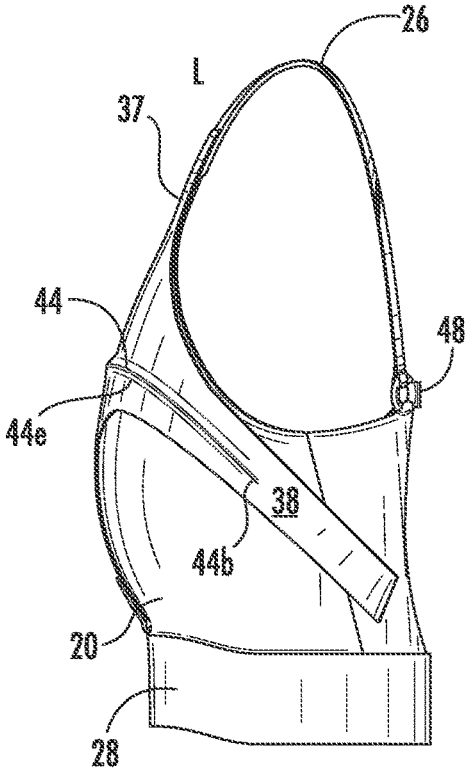
FIG. 1B illustrates a left side view of an outer side of the upper body garment of FIG. 1A.
Figure 1C:
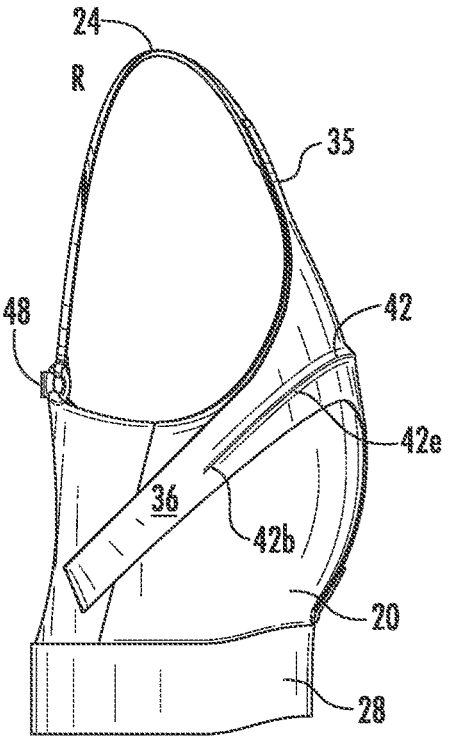
FIG. 1C illustrates a right side view of an outer side of the upper body garment of FIG. 1A.

Inferior portions 36*a*, 38*a* of the right and left side extensions 36, 38 include side extension fasteners 36*c*, 38*c*, respectively, for removably attaching the right 36 and left side extensions 38 to the inner layer 20. Side views shown in FIG. 1B and FIG. 1C illustrate the side extensions 36, 38 in the fastened position over inner layer 20. The side extension fasteners could comprise any of a known variety of fasteners, including, but not limited to hook and loop fasteners (such as Velcro®), snaps, ribbon ties, zippers, buttons, and/or one or more slidable hook fasteners. A slidable hook fastener includes a slidable hook that lays generally flat against the wearer's body. The slidable hook can attach to an elongated eye or channel, in some embodiments, to another slidable hook fastener. In the implementation shown in FIGS. 1A-6, the side extension fasteners 36*c*, 38*c* and corresponding fasteners on the inner layer 20 are hook and loop fasteners. Side extensions 36, 38 are pulled against the respective outer lateral portions of the wearer's breasts and are secured in place and with the inner layer 20 via the side extension fasteners 36*c*, 38*c* and corresponding fasteners on the lateral and/or posterior sides of the inner layer 20.

As shown in FIG. 3, the outer layer 22*d* of the front central region 22 defines an opening 22*c* disposed between the right 22*a* and left cups 22*b* that extends through inner upper material 22*e*. The opening 22*c* lies superiorly of the band 28. In some implementations, opening 22*c* is entirely defined by the materials of the front central region 22 of the inner layer 20 and the inner side 23 of the inner layer 20, and does not contact band 28. The opening lies below a plane that extends through an apex of each of the cups 22*a*, 22*b* and that is parallel to the sagittal plane of the wearer. In addition, the garment 10 includes a loop 46 that has an inner portion 46*a* that is coupled to the inner side 23 of the inner layer 20 adjacent to the opening 22*c* and an outer portion 46*b* that extends through the opening 22*c* such that the outer portion 46*b* is adjacent the outer side 21 of the inner layer 20. In another embodiment, such as the one shown in FIG. 25, upper and lower openings 22*c*' and 22*c*" are vertically arranged on front central region 22, thereby forming a strip of material 22*i* extending horizontally therebetween.

Figure 6:
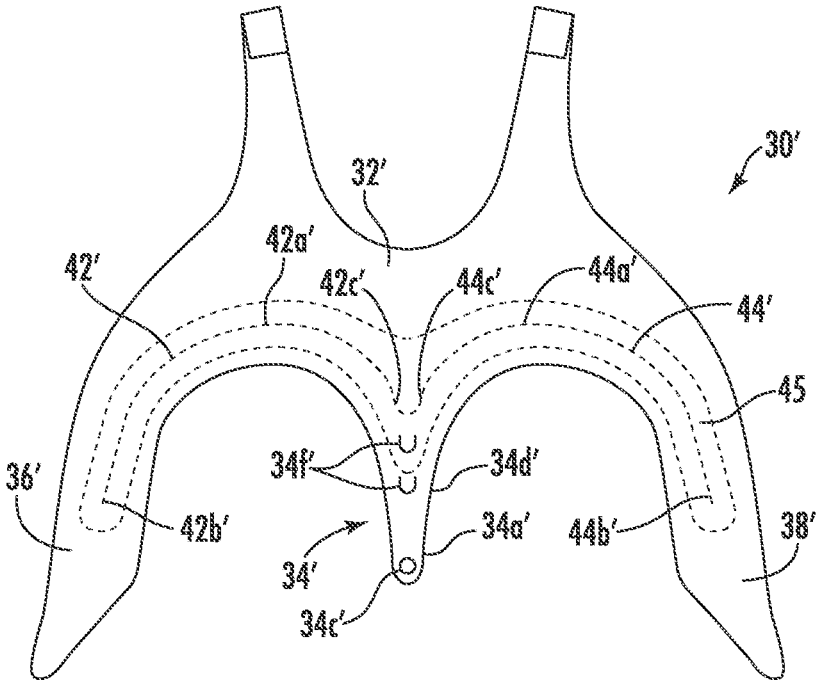
FIG. 6 illustrates a plan view of an outer side of an outer layer of an upper body garment according to another implementation.

Turning back to FIG. 5, an inferior end portion 34*a* of the middle extension 34 is extendable through the outer portion 46*b* of the loop 46 and is attachable to an intermediate portion 34*d* of the middle extension 34. The intermediate portion 34*d* is disposed between the inferior end portion 34*a* and a superior portion 34*b* that is coupled to the top portion 32 of the outer layer 30. The inferior end portion 34*a* of the middle extension 34 can be pulled upwardly after being thread through the outer portion 46*b* of the loop 46 to cinch the outer layer 30 against the upper portion of the wearer's breasts. The inferior end portion 34*a* of the middle extension 34 comprises a first middle extension fastener 34*c*, and the intermediate portion 34*d* of the middle extension 34 comprises a second middle extension fastener 34*e*. The first 34*c* and second middle extension fasteners 34*e* are coupled to the outer side 31 of the middle extension 34. The first middle extension fastener 34*c* is removably attachable with the second middle extension fastener 34*e* to couple the middle extension 34 to the inner layer 20. For example, in one implementation, the shoulder strap fasteners 35*a*, 37*a*, 24*a*, 26*a* are coupled first, the middle extension 34 is coupled through the loop 46 second, and the side extensions 36, 37 are coupled to the inner layer 20 third to secure the outer layer 30 against the wearer's chest. The pressure provided by the outer layer 30 can be increased by pulling the middle extension 34 further through the outer loop 46, pulling the shoulder strap extensions further superiorly, and/or pulling the side extensions 36, 37 further around the wearer's side and/or back. By pulling the middle extension 34 through the loop 46, the cups 22*a*, 22*b* of the inner layer 20 are lifted superiorly, which provides more support to the breasts. In the implementation of FIG. 5, the fasteners of middle extension 34 are of the hook and loop variety. In another implementation, such as the one shown in FIG. 6, the inferior end portion 34*a*' of middle extension 34' comprises first middle extension fastener 34*c*' that is removably attachable to either of the second middle extension fasteners 34*f*' on the intermediate portion 34*d*' of middle extension 34'. The fasteners 34*c*', 34*f*' of the implementation shown in FIG. 6 are of the hook and eye variety.

Figure 24:
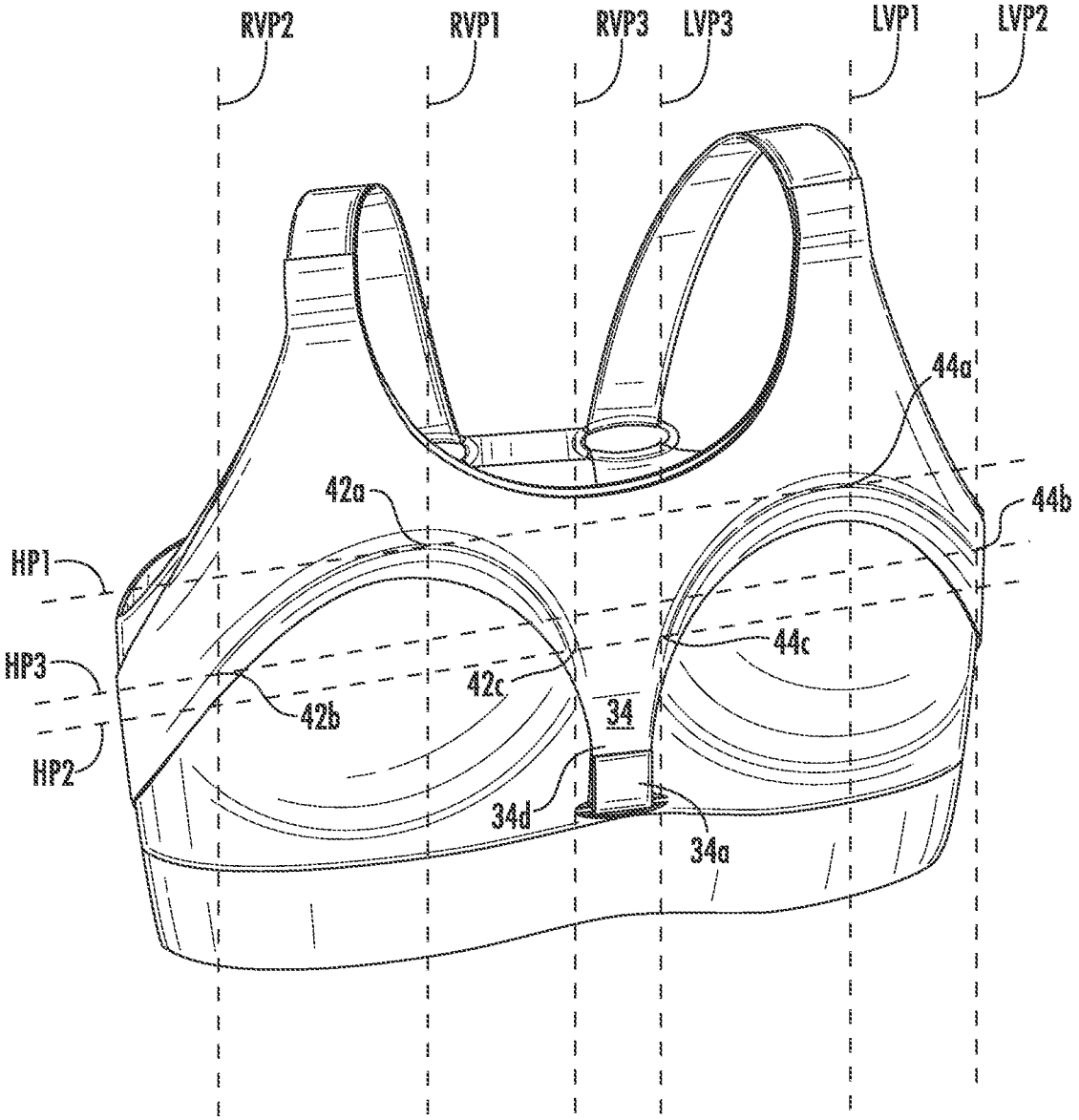
FIG. 24 illustrates a perspective view of an implementation of an upper body garment according to another implementation.
Figure 25:
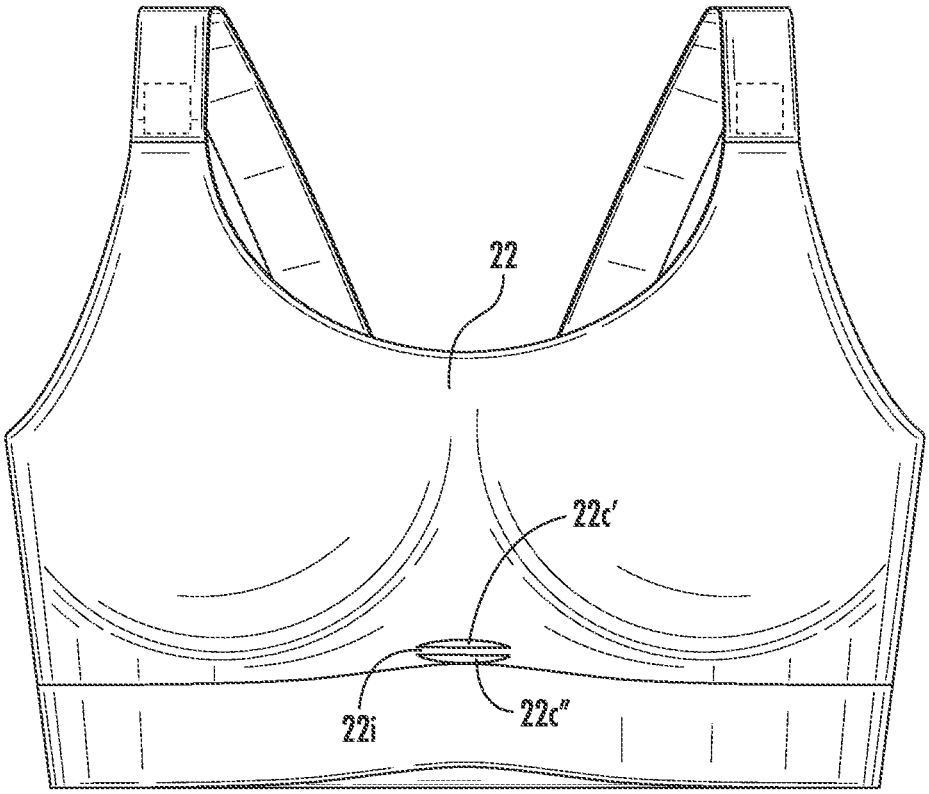
FIG. 25 illustrates a plan view of an outer side of an anterior side of an inner layer according to the implementation of FIG. 24.

For the implementation shown in FIGS. 24 and 25, middle extension 34 can be pushed through upper opening 22*c*' from the outer side of the inner layer 20, and then threaded back through lower opening 22*c*", from the inner side of the inner layer 20 to the outer side of the inner layer. The inferior end 34*a* of the middle extension 34 can then be fastened to the intermediate portion 34*d* of the middle extension 34.

In some implementations, the loop 46 is a stiff or rigid plastic or metal ring, for example, and the inner portion 46*a* of the ring 46 is sewn or welded onto the inner side 21 of the inner layer 20. However, in other implementations, the loop may be a flexible material, such as a cord, yarn, or flexible plastic. In addition, in other implementations, the loop may include two ends that are part of the inner portion of the loop and are coupled to the inner side of the inner layer, and an intermediate portion of the loop is the outer portion that extends from the opening.

Figure 7:
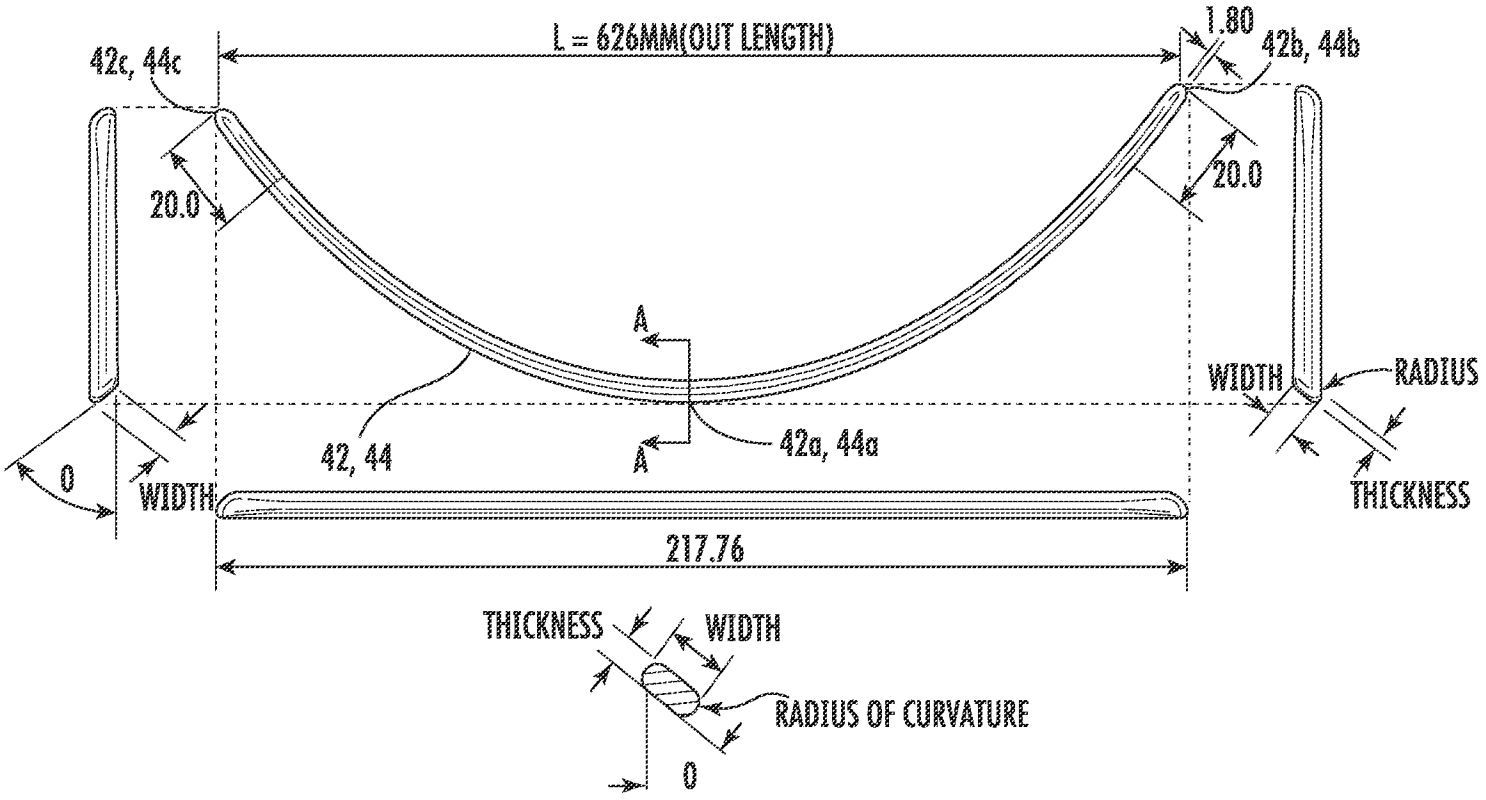
FIG. 7 illustrates a stiffener according to one implementation.
Figure 8:
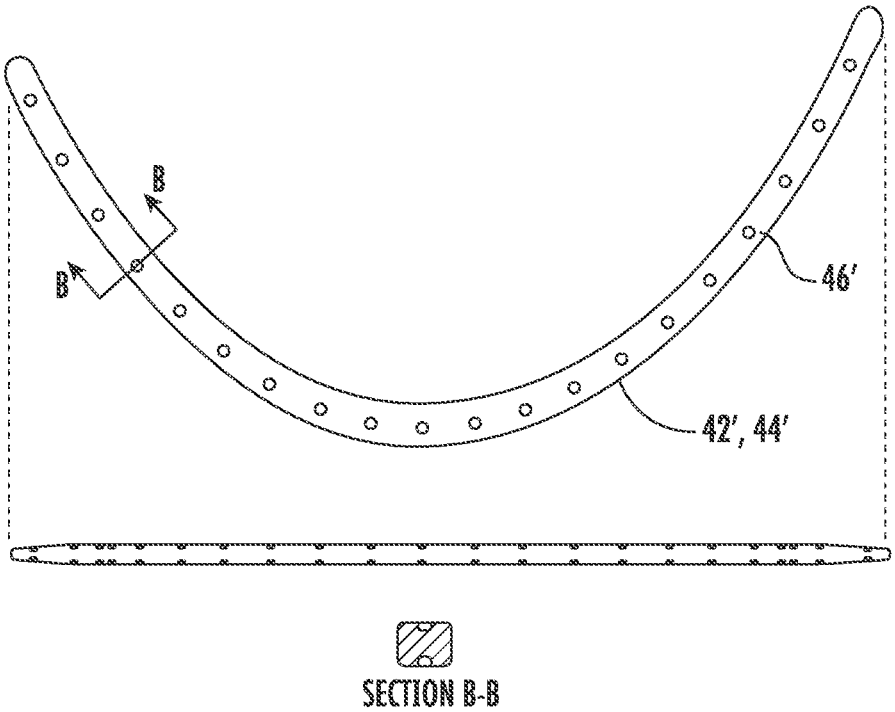
FIG. 8 illustrates a stiffener according to another implementation.

To provide sufficient pressure above and/or against the upper portion of the wearer's breasts, the outer layer 30 includes a right stiffener 42 and a left stiffener 44, as seen in FIG. 5. Examples of the stiffeners 42, 44 that may be used are shown in FIGS. 7 and 8. As shown in FIG. 7, each stiffener 42, 44 includes a stiff portion that does not stretch along a longitudinal axis thereof (or has a limited ability to stretch in the axial direction) but is flexible about the axis such that the stiffener 42, 44 can bend along and against (or adjacent to) a contour of an upper portion of a base of each breast. The upper portion of the base of each breast includes at least a portion of each breast that is disposed superiorly from a plane that extends parallel to the wearer's sagittal plane and through a center of each breast. The right 42 and left stiffeners 44 each have an arcuate shape with an apex 42*a*, 44*a*, a lateral end 42*b*, 44*b*, and a medial end 42*c*, 44*c*, and the longitudinal axis of each stiffener 42, 44 extends through the respective ends 42*b*, 42*c*, 44*b*, 44*c* of each stiffener 42, 44. The stiffeners 42, 44 may be formed of a silicone, plastic, and/or metal material. In the implementation shown in FIG. 7, the stiffener 42, 44 comprises thermoplastic polyurethane (TPU) and has a thickness of 3 mm and a width of 7 mm. The longitudinal edges of the stiffener 42, 44 have a radius of curvature of 1.25 mm, and a plane that includes a side of the stiffener 42, 44 that sits against the wearer's body is at an angle θ of 52.5° with a plane that is parallel to the frontal plane of the wearer.

As shown in FIG. 1A, FIG. 1B, and FIG. 1C, when worn, the apex 42*a*, 44*a* of each stiffener 42, 44 is disposed superiorly relative to the lateral 42*b*, 44*b* and medial ends 42*c*, 44*c* of the respective stiffener 42, 44. In addition, when the garment 10 is worn, the apex 42*a* of the right stiffener 42 lies in a first horizontal plane HP1 that is parallel to the wearer's sagittal plane and a first right vertical plane VRP1 that is parallel to the wearer's frontal plane. The apex 44*a* of the left stiffener 44 lies in the first horizontal plane HP1 and a first left vertical plane LVP1 that is parallel to the first right vertical plane RVP1. The lateral ends 42*b*, 44*b* of the stiffeners 42, 44 lie in a second horizontal plane HP2 that is parallel to and spaced apart from the first horizontal plane HP1. Lateral ends 42*b*, 44*b* of the stiffeners 42, 44 also lie in second right RVP2 and left vertical planes LVP2 that are parallel to and spaced apart from the first right RVP1 and left vertical planes LVP1 and from each other. And, the medial ends 42*c*, 44*c* of the stiffeners 42, 44, respectively, lie in a third horizontal plane HP3 that is parallel to and spaced apart from the first horizontal plane HP1. Medial ends 42*c*, 44*c* of the stiffeners 42, 44 also lie in third right RVP3 and left vertical planes LVP3 that are parallel to and spaced apart from the first right RVP1 and left vertical planes LVP1. Thus, by pulling the middle extension 34 and the side extensions 36, 37 tautly and fastening them into place relative to the inner layer 20 as described above, each stiffener 42, 44 wraps around the contour of the upper portion of each breast (above and/or over the breast tissue), which prevents the breasts from moving upwardly or side to side during physical movement of the wearer. FIG. 24 shows an embodiment wherein the lateral ends 42*b*, 44*b* are positioned superiorly to medial ends 42*c*, 44*c*. As such, HP2 is positioned superiorly to HP3.

The stiffeners 42, 44 can each be encased in a material 45, as shown in the implementation of FIG. 6. The material 45 encasing the right stiffener 42' is attached to the inner side of the outer layer 30 such that the apex 42*a'* of stiffener 42' is disposed adjacent the top portion 32', the lateral end 42*b'* is disposed adjacent the right-side extension 36', and the medial end 42*c'* is disposed adjacent the middle extension 34'. FIGS. 1B and 1C show side views of an implementation wherein the stiffeners 42, 44 are attached to the inner side of the outer layer 30. The stiffeners protrude slightly to form ridges 42*e*, 44*e* on the outer side of the outer layer 30. The material 45 encasing the left stiffener 44' is attached to the inner side of the outer layer 30' such that the apex 44*a'* is disposed adjacent the top portion 32', the lateral end 44*b'* is disposed adjacent the left side extension 38', and the medial end 44*c'* is disposed adjacent the middle extension 34'. In some implementations, the material 45 encasing stiffeners 42, 44 is a foamed material that is coupled to the outer layer 30. The transition between the edges of the foamed material and material of the outer layer 30 is smooth to avoid irritating the skin of the wearer. During fabrication, the stiffeners 42, 44 can be embedded in the foamed material 45, then molded by heat processing. The melting point of the stiffeners 42, 44 must be such that it can be shaped by heat processing without melting the foamed material.

FIG. 8 illustrates a stiffener 42', 44' with a plurality of recesses 46' defined in an outer surface thereof. The encasing material 45 can be disposed within the recesses, for example, by a foaming process, which prevents the encasing material from being uncoupled from or moving relative to the stiffener.

In the implementation shown in FIGS. 1A-6, the right and left shoulder strap extensions 35, 37 of the outer layer 30 couple to or are adjacent to an anterior side of the right and left shoulder straps 24, 26, respectively, of the inner layer 20. However, in other implementations (not shown), the right and left shoulder strap extensions 35, 36 may extend over the wearer's shoulders and couple to a posterior side of the right and left shoulder straps 24, 26 or to a portion of the shoulder straps 24, 26 that is on top of the wearer's shoulders. In some implementations (not shown), the inner layer may be strapless, and the right and left shoulder strap extensions 35, 37 of outer layer 30 may extend fully over the shoulders and down the back of the wearer to couple to the posterior side of inner layer 20 or band 28*b*.

FIGS. 9-23 illustrates various alternative implementations.

Figure 9:
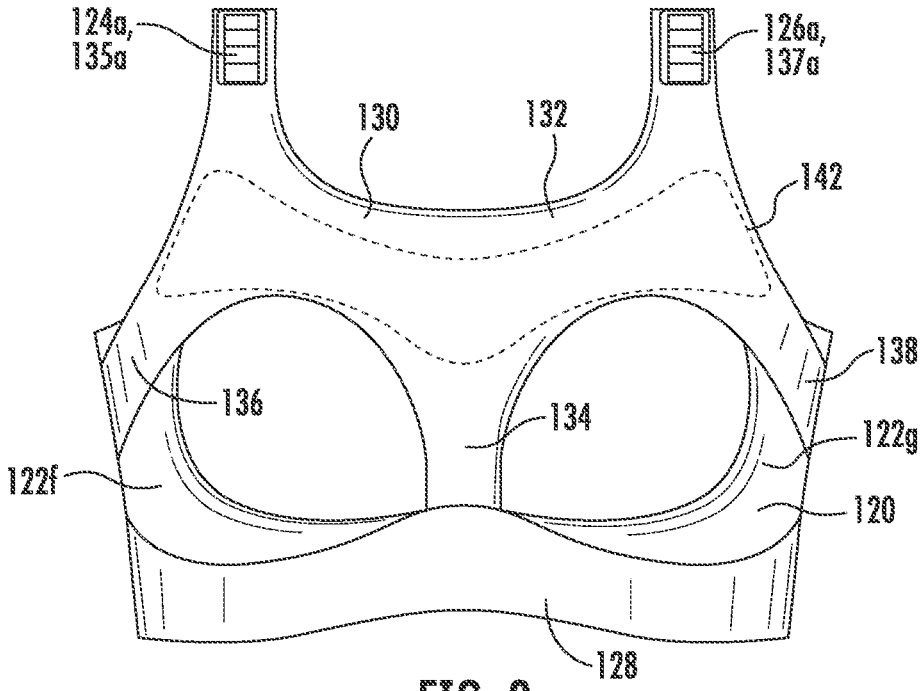
FIG. 9 illustrates a plan view of an outer side of an anterior, or front, side an upper body garment according to another implementation.
Figure 10:
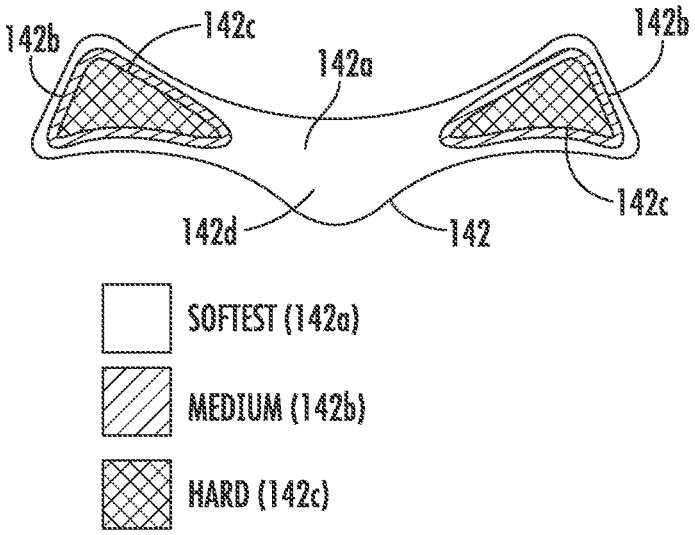
FIG. 10 illustrates a plan view of a stiffener included with the upper body garment shown in FIG. 9.
Figure 11:
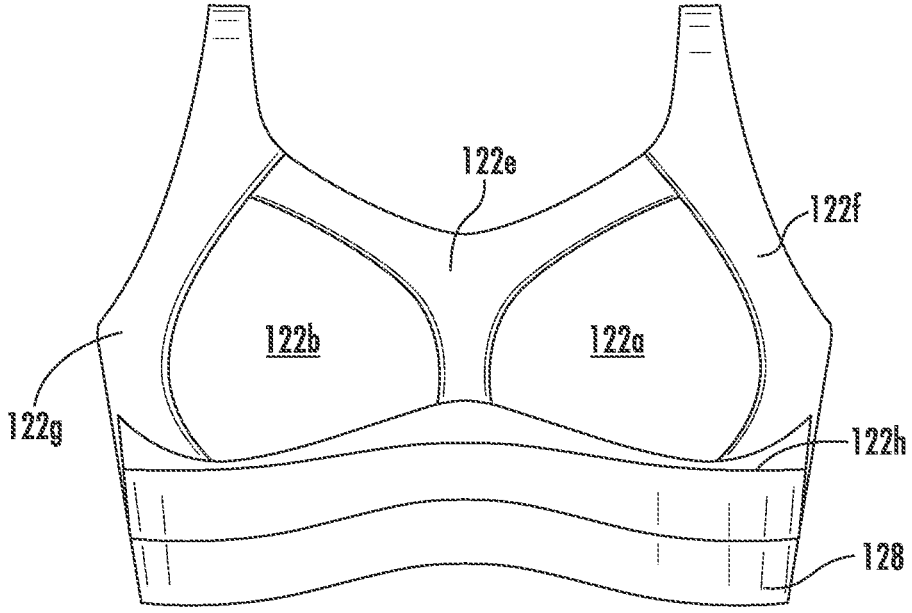
FIG. 11 illustrates a plan view of an inner side of the inner layer shown in FIG. 9.
Figure 12:
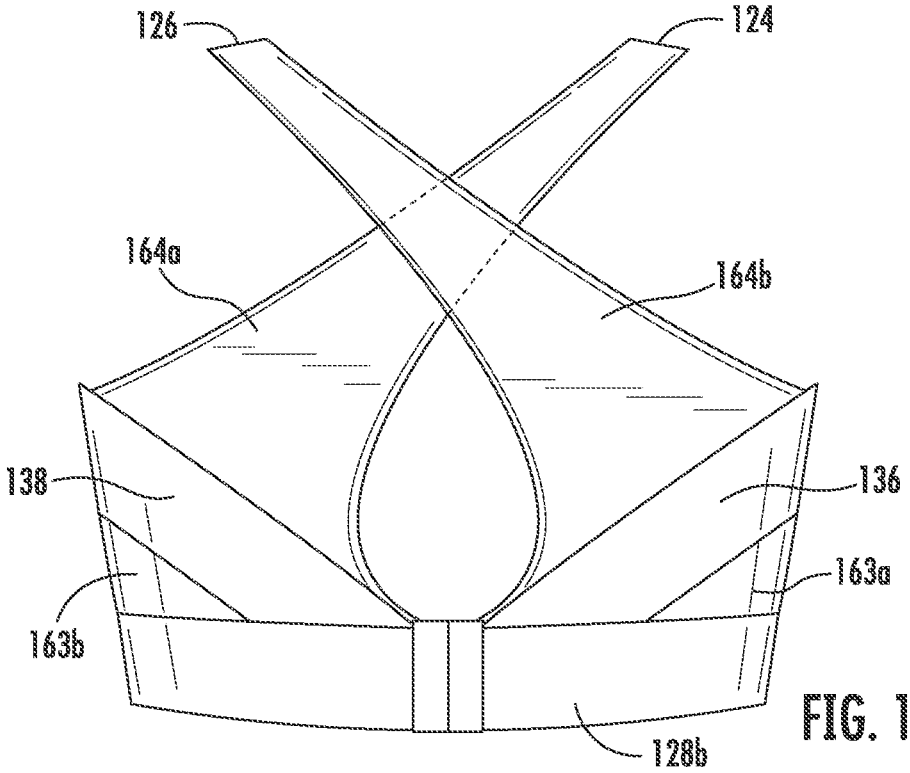
FIG. 12 illustrates a plan view of an outer side of a posterior, or back, side of the upper body garment shown in FIG. 9.
Figure 13:
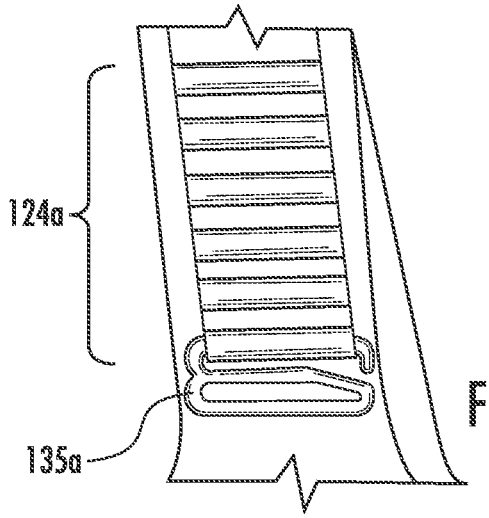
FIG. 13 illustrates a plan view of the strap fastener shown FIG. 9.
Figure 14:
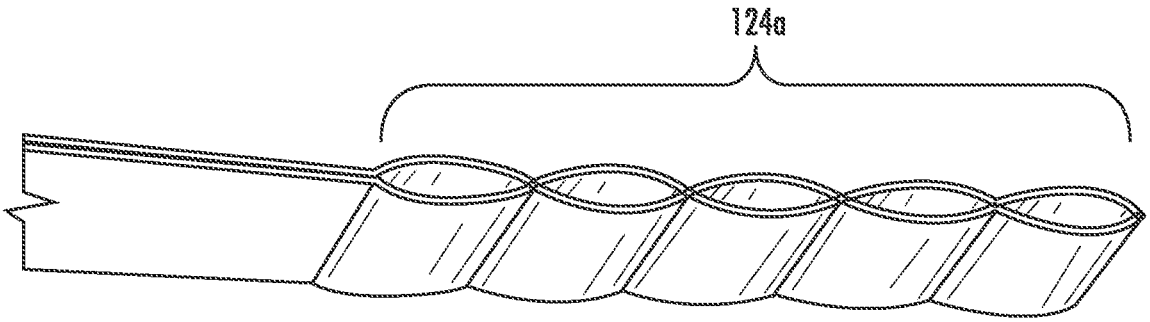
FIG. 14 illustrates a side view of the strap fastener shown in FIG. 13.
Figure 15:
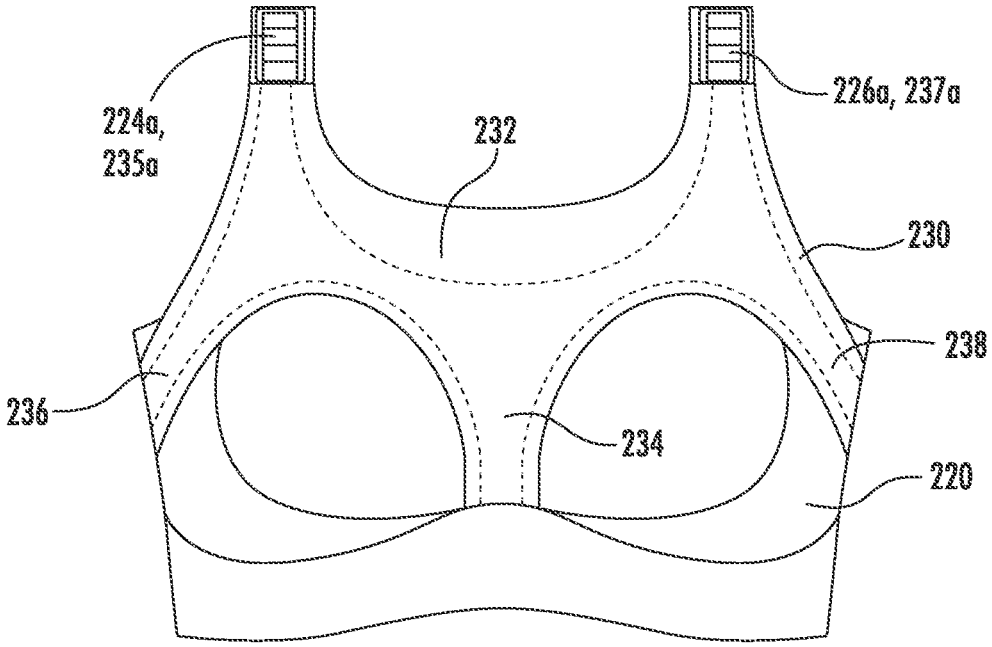
FIG. 15 illustrates a plan view of an outer side of an anterior, or front, side an upper body garment according to another implementation.
Figure 16:
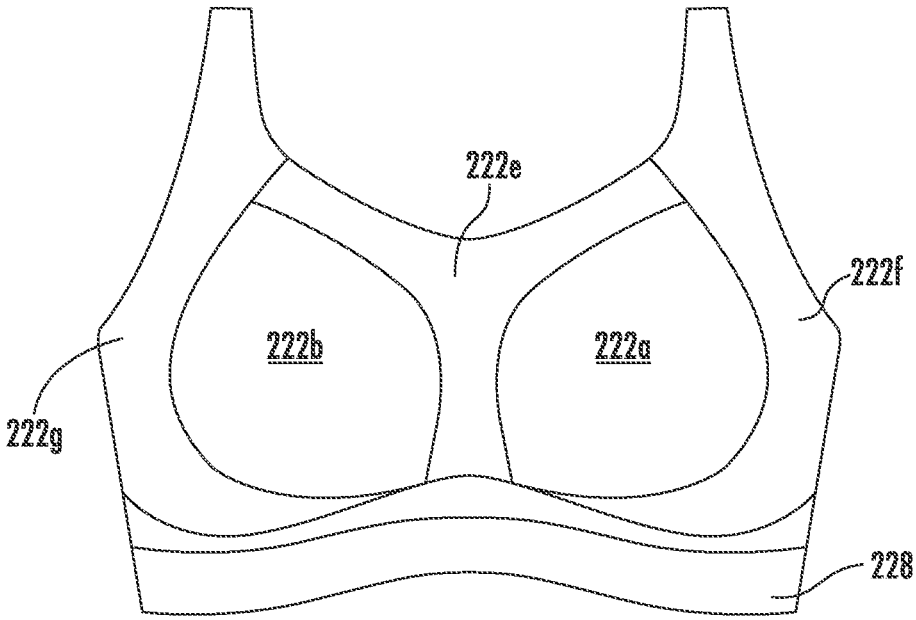
FIG. 16 illustrates a plan view of an outer side of an inner layer shown in FIG. 15.
Figure 17:
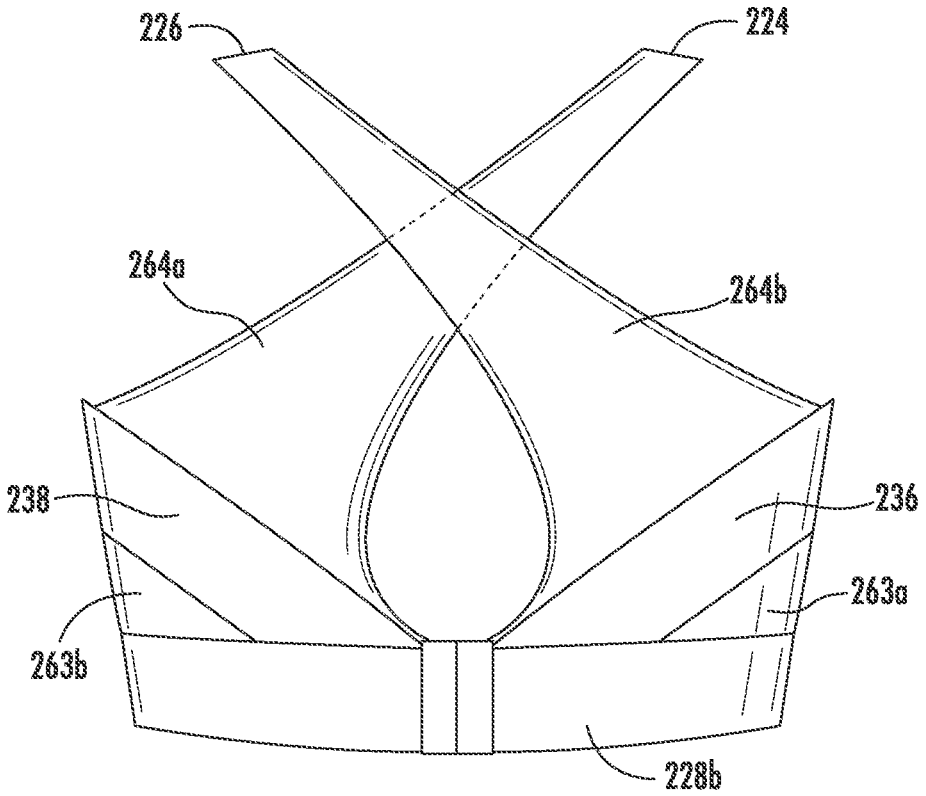
FIG. 17 illustrates a plan view of an outer side of a posterior side of the garment shown in FIG. 15.

For example, in the implementation shown in FIGS. 1 and 5-8, the outer layer 30 includes two stiffeners 42, 44. However, in other implementations, such as shown in FIGS. 9 and 10, the outer layer 30 may include one stiffener 142 that is coupled to and extends laterally along at least a portion of the top portion 132 of the outer layer 130. An outline of where the stiffener 142 is coupled to the inner side of the top portion 132 is shown in FIG. 9 by the dotted line, and the stiffener 142 is shown in FIG. 10. The stiffener 142 is a M-shaped plastic piece that includes a first portion 142*a* that has a first hardness, two second portions 142*b* that have a second hardness, and two third portions 142*c* that have a third hardness. The third hardness is harder than the second hardness, and the second hardness is harder than the first hardness. The third portions 142*c* are triangular shaped and are disposed adjacent each lateral end of the stiffener 142. The second portions 142*b* are also triangular shaped and each extend around a respective perimeter of the third portions 142*c*. The first portion 142*a* extends around the perimeters of the second portions 142*b* and through a central portion 142*d* of the stiffener 142. The central portion 142*d* of the stiffener 142 is configured for being disposed above a central portion of the wearer's chest above and/or over the upper portion of the wearer's breasts, and the second and third portions 142*b*, 142*c* are configured for being disposed above each breast such that central planes that are parallel to the transverse plane of the wearer extend through a central portion of each breast and the second and third portions 142*b*, 142*c*. The first hardness is sufficiently soft to conform, at least in part, against the upper lateral portions of the wearer's breasts.

Figure 18:
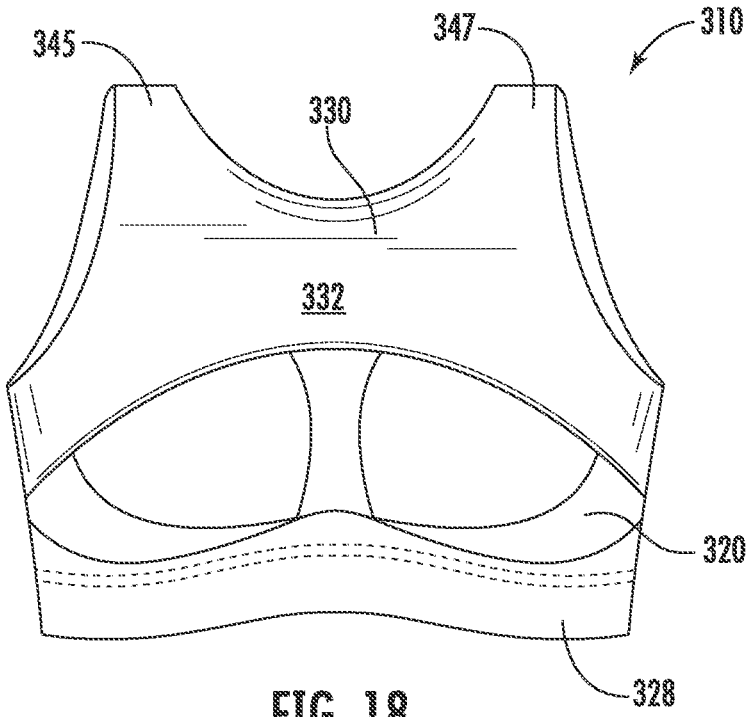
FIG. 18 illustrates a plan view of an anterior, or front, side of an upper body garment according to another implementation.
Figure 19:
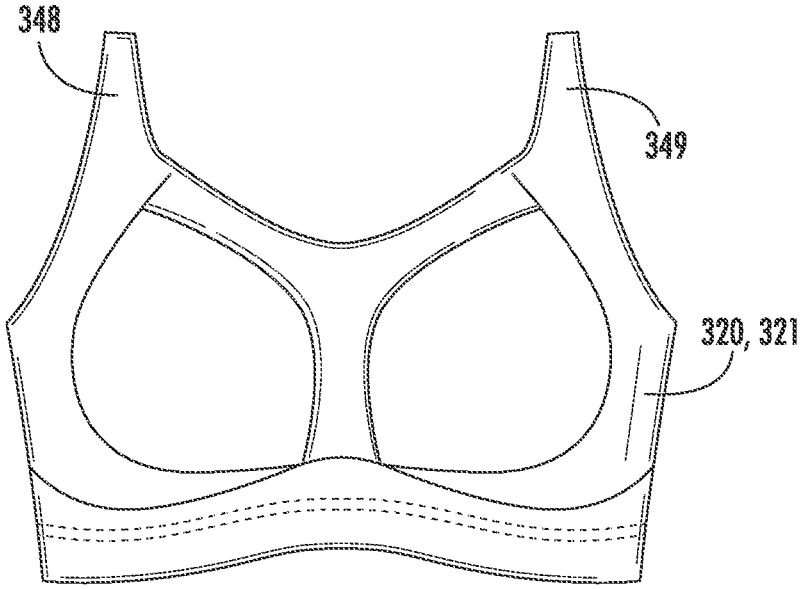
FIG. 19 illustrates a plan view of an outer side of an anterior side of an inner layer shown in FIG. 18.
Figure 21:
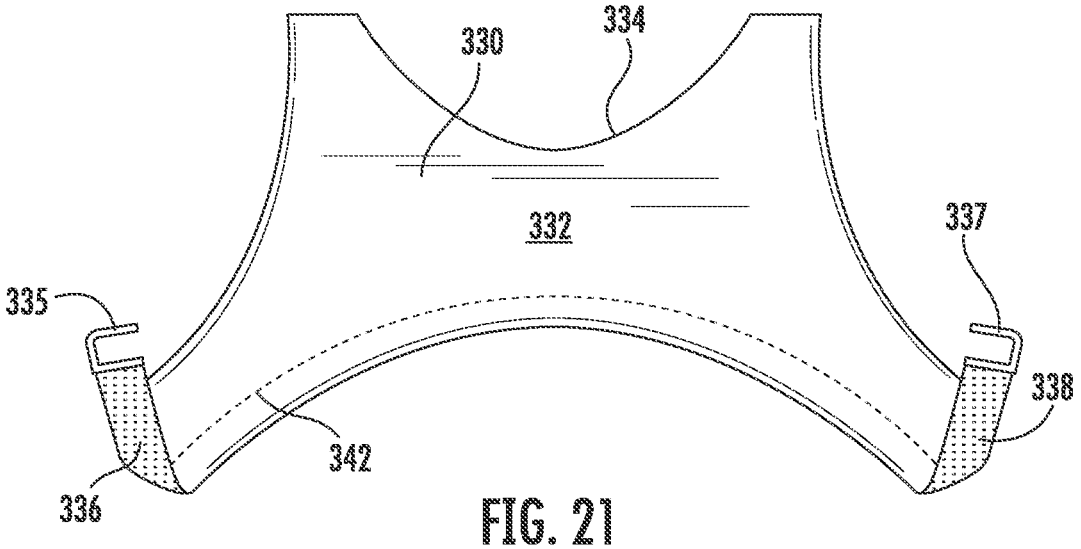
FIG. 21 illustrates a plan view of an outer side of an outer layer shown in FIG. 18.
Figure 22:
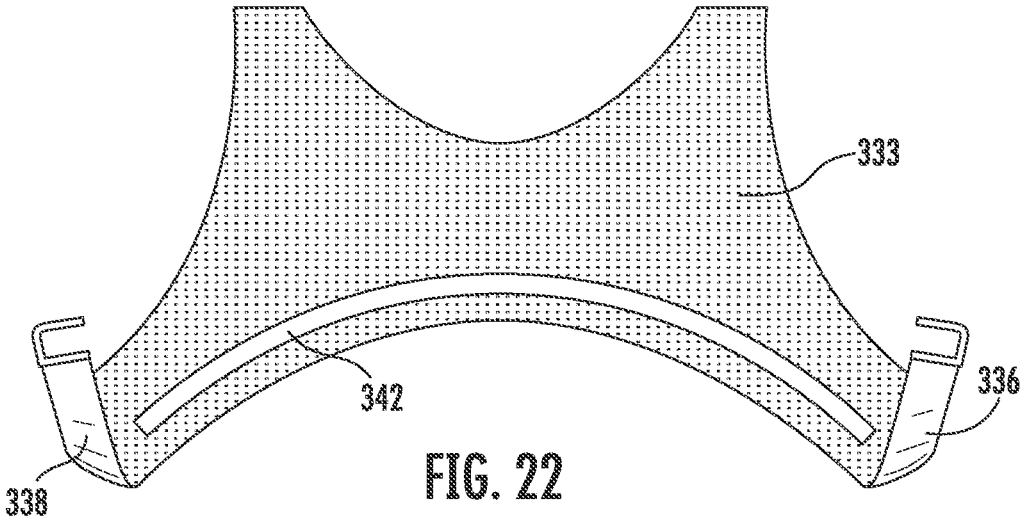
FIG. 22 illustrates a plan view of an inner side of the outer layer shown in FIG. 21.

FIGS. 18, 21, and 22 provide another example of an implementation that includes one stiffener instead of the two stiffeners shown in FIGS. 1 and 5-8. The stiffener 342 is an arcuate shaped elongated material that is less elastic in its axial direction than the material(s) of the outer layer 330 but is bendable about its axis. For example, the stiffener may be an arcuate shaped piece of plastic, silicone, and/or metal, that extends laterally along a portion of the inner side 333 of a front portion 332 of the outer layer 330. The stiffener 342 extends above and/or over the upper portions of both breasts when worn over the inner layer 320. The outer layer 330 also includes a wire mesh embedded in a foam layer that is sandwiched between two pieces of fabric to provide further pressure to resist the upward and lateral movement of the breasts. Furthermore, a superior edge of the outer layer 330 extends superiorly relative to a superior edge of the inner layer 320 to provide additional pressure above the breasts.

In addition, the implementation shown in FIGS. 1A-6 illustrates an outer layer 30 that includes a front portion that is removably attached to the inner layer 20. However, in some implementations, the outer layer is fixedly attached to at least a portion of the inner layer. In the implementations shown in FIGS. 9-17, inferior edges of right extensions 136, 236, left extensions 138, 238, and middle extensions 134, 234 are fixedly coupled to the inner layers 120, 220, respectively. The edges may be coupled by bonding and/or sewing, and/or portions of inner sides of the extensions 134, 136, 138, 234, 236, 238 may be bonded to outer sides of the inner layers 120, 220. The right and left shoulder strap extensions 135, 137, 235, 237 have fasteners that engage corresponding fasteners coupled to the shoulder straps 124, 126, 224, 226, respectively, to adjustably couple the shoulder strap extensions 135, 137, 235, 237 to the inner layer 120, 220. By pulling the shoulder strap extensions 135, 137, 235, 237 superiorly, more pressure is applied by the outer layer 130, 230 to the upper portion of the breasts. In addition, superior edges of the top portions 132, 232 of the outer layers 130, 230 extend superiorly relative to superior edges of the front central regions 122, 222 of the inner layers 120, 220, respectively. The right and left side extensions 136, 138, 236, 238 also extend around the sides and portions of the back of the wearer and are coupled to posterior portions 128*b*, 228*b* of the bands 128, 228, respectively.

Figure 23:
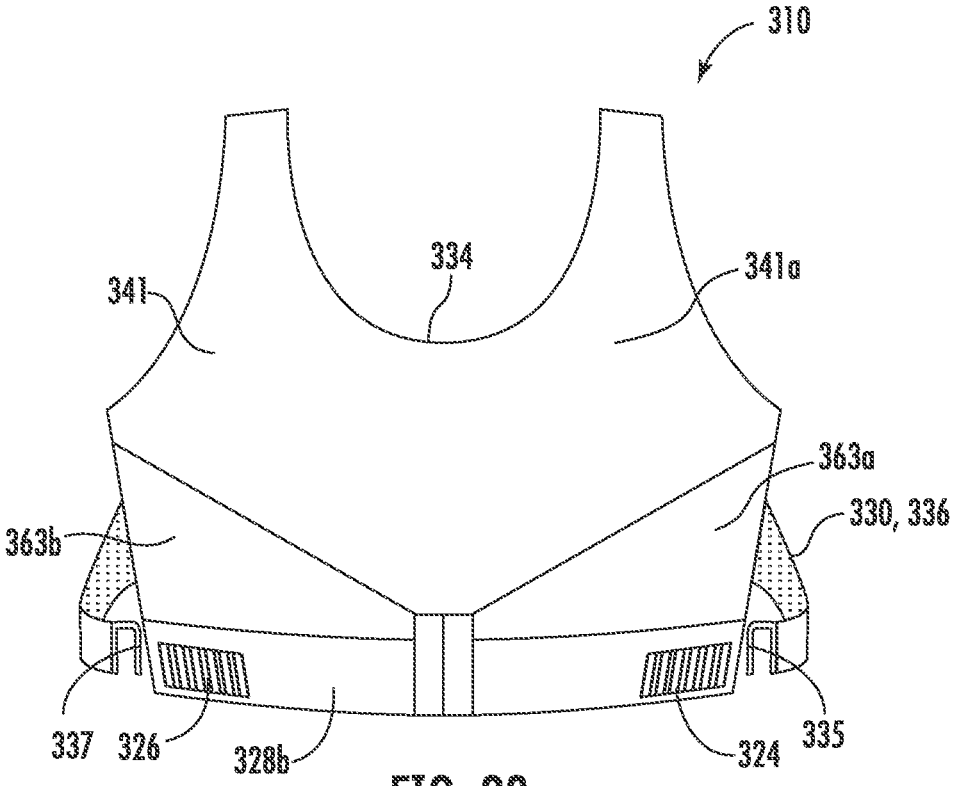
FIG. 23 illustrates a plan view of an outer side of a posterior, or rear, side of the upper body garment shown in FIG. 18.

As another example, the implementation shown in FIGS. 18-23 includes an outer layer 330 that includes front portion 332 and a back portion 341. The front portion 332 has right and left extensions 336, 338. The right and left extensions 336, 338 have inferior end portions that have fasteners 335, 337 for coupling with corresponding fasteners 324, 326 coupled to a back portion of the inner layer 320. For example, as shown in FIG. 23, the corresponding fasteners 324, 326 are coupled to a posterior portion 328*b* of the band 328. The fasteners 324, 326 include a plurality of horizontally oriented eyes (or channels having vertical axes), and the fasteners 335, 337 are hooks. The tightness of the outer layer 330 against the wearer's body can be increased by engaging the hooks 335, 337 into eyes 324, 326, respectively, that are closer to a transverse plane of the wearer, and the tightness of the outer layer 330 can be decreased by engaging eyes 324, 326 that are closer to lateral sides of the wearer. Right and left shoulder strap extensions 345, 347 are fixedly coupled to right and left shoulder straps 348, 349, respectively (e.g., via bonding or seams).

The back portion 341 extends across a portion of the wearer's back and attaches to right and left back portions 363*a*, 363*b*. The back portion 341 includes an elastic mesh breathable material 341*a* positioned above the right and left back portions 363*a*, 363*b*.

In the implementation shown in FIG. 4, support below and around at least a portion of the sides of each breast are provided by the cups 22*a*, 22*b*. However, in the implementations shown in FIGS. 11 and 16, the inner layers 120, 220 include right and left lateral side materials 122*f*, 122*g*, 222*g*, 222*f* that extend below a portion of each breast and along respective lateral sides of each breast. The lateral side materials 122*f*, 122*g*, 222*f*, 222*g* are coupled to the band 128, 228. Each inner layer 120, 220 also includes an upper material 122*e*, 222*e* that is Y-shaped and is bonded to cups 122*a*, 122*b*, 222*a*, 222*b* and the right and left side materials 122*f*, 122*g*, 222*g*, 222*f*. The lateral side materials 122*f*, 122*g*, 222*f*, 222*g* further extend at least to the wearer's shoulders and around the lateral sides of the wearer and across a portion of the wearer's back to define right and left back portions 163*a*, 163*b*, 263*a*, 263*b*. The right and left extensions 136, 138, 236, 238 are coupled to the superior edges of the right and left back portions 163*a*, 163*b*, 263*a*, 263*b*. In the implementations shown in FIGS. 12 and 17, at least a back portion of the shoulder straps 124, 126 includes a breathable material 164*a*, 164*b*, 264*a*, 264*b* (e.g., mesh or breathable fabric) that crosses along the back of the wearer and is coupled to the left and right extensions 138, 136, 238, 236, respectively. And, in the implementation shown in FIG. 11, the inner layer 120 also includes an inner lower material 122*h* that extends below both breasts and is coupled to inferior portions of the upper material 122*e*, the cups 122*a*, 122*b*, and the lateral side materials 122*f*, 122*g*. The inner lower material 122*h* provides additional support for the breasts.

Figure 20:
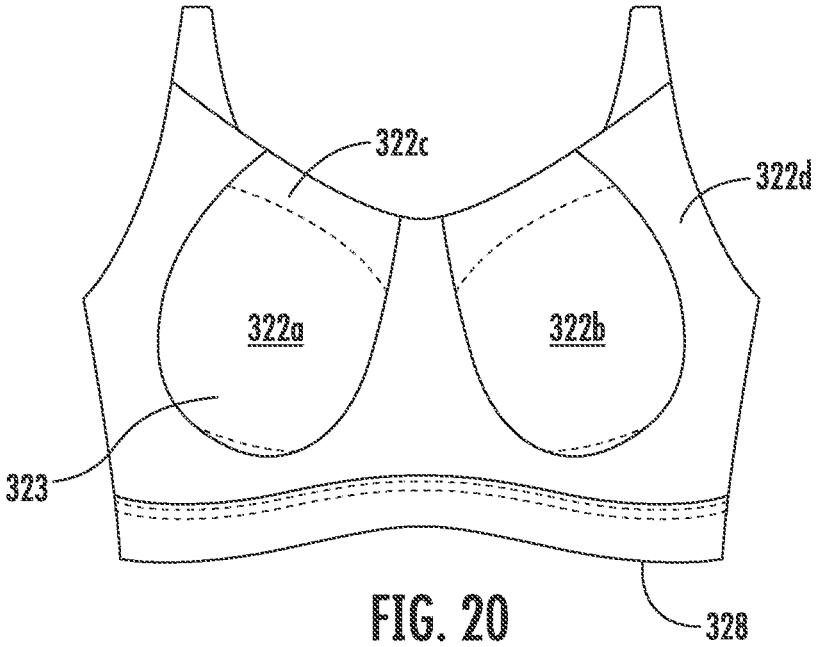
FIG. 20 illustrates a plan view of an inner side of an anterior side of the inner layer shown in FIG. 19.

In the implementation shown in FIG. 20, the front portion 322 of the inner layer 320 includes a W-shaped inner material 322*d* that is coupled to an inner side 323 of the outer material 322*c*. Cups 322*a*, 322*b* are coupled to the W-shaped inner material between the lateral and medial extensions of the inner material 322*d* and to the outer material 322*c*. The inner material 322*d* provides additional support below and around the sides of the breast tissue. The inner material 322*d* is coupled at an inferior edge to the band 328.

Any material used to make the garment may vary according to the intended size of the wearer. For example, larger sizes may use materials with lower elasticity to provide greater compression and further limit movement of the breasts.

The corresponding structures, materials, acts, and equivalents of any means or step plus function elements in the claims below are intended to include any structure, material, or act for performing the function in combination with other claimed elements as specifically claimed. The specification and figures have been presented for purposes of illustration and description, but they are not intended to be exhaustive or limiting to the claims in the form disclosed. Many modifications, variations, and/or combinations of the features disclosed herein will be apparent to those of ordinary skill in the art without departing from the scope and spirit of the claims. The implementations were chosen and described to best explain principles of the claims and the practical application and to enable others of ordinary skill in the art to understand various implementations with various modifications as are suited to the particular use contemplated.

The invention claimed is:

1. An upper body garment for limiting upward movement of a wearer's breasts, the upper body garment comprising:

an inner layer comprising a laterally extending central region for extending across a wearer's breasts and a band for extending around a chest and back of the wearer, wherein a front portion of the band extends inferiorly from the laterally extending central region; and an outer layer comprising an upper edge that partially defines a laterally extending top portion of the outer layer, the upper edge extending continuously from a right side of the outer layer to a left side of the outer layer, the outer layer further comprising a lower edge removed from the upper edge and positioned inferiorly to the upper edge, the lower edge at least partially defining a right extension that extends inferiorly from a right side of a top portion of the outer layer, a left extension that extends inferiorly from a left side of the top portion, and a middle extension that extends inferiorly from a central portion of the top portion;

wherein the outer layer further comprises two discontinuous stiffeners covered by a material of the outer layer and positioned between the upper and lower edges of the outer layer, each of the stiffeners extending laterally along the top portion of the outer layer and being less elastic than the material of the outer layer;

wherein the outer layer is separately formed from the inner layer and is removably attachable over a portion of an outer side of the inner layer such that, when attached, the top portion of the outer layer is disposed over at least a portion of the central region of the inner layer, and an inner side of the top portion faces the outer side of the inner layer; and wherein a height of the top portion of the outer layer, as measured in a superior-inferior direction at a narrowest region thereof between the right and left side extensions, is narrower than a height of the central region of the inner layer at a narrowest region thereof.

2. The upper body garment of claim 1, wherein the outer layer further comprises right and left shoulder strap extensions extending superiorly from the right and left portions, respectively, of the laterally extending top portion.

3. The upper body garment of claim 2, wherein the outer layer further comprises right and left outer layer shoulder strap fasteners for removably attaching to corresponding right and left inner layer shoulder strap fasteners attached to the inner layer.

4. The upper body garment of claim 1, wherein the two discontinuous stiffeners comprise a right stiffener and a left stiffener, and wherein both the right stiffener and the left stiffener are coupled to and extend laterally along at least a part of the top portion of the outer layer, the right stiffener being disposed against a superior portion of the wearer's right breast and the left stiffener being disposed against a superior portion of the wearer's left breast.

5. The upper body garment of claim 4, wherein the right and left stiffeners each have an arcuate shape with an apex, a lateral end, and a medial end, wherein the apex of each stiffener is disposed superiorly from the lateral and medial ends.

6. The upper body garment of claim 5, wherein, when the garment is worn, the apex of each of the right stiffener and the left stiffener lies in a first horizontal plane that is parallel to the wearer's sagittal plane and a first right and left vertical planes that are parallel to the wearer's frontal plane and each other, the lateral ends of each of the right and left stiffeners lie in a second horizontal plane that is parallel to and spaced apart from the first horizontal plane and second right and left vertical planes that are parallel to and spaced apart from the first right and left vertical planes, and the medial ends of each of the right and left stiffeners lie in a third horizontal plane that is parallel to and spaced apart from the first horizontal plane and a third right and left vertical planes that are parallel to and spaced apart from the first vertical plane.

7. The upper body garment of claim 4, wherein the two discontinuous stiffeners are encased in a material that is attached to and extends laterally along at least a part of the top portion of the outer layer.

8. The upper body garment of claim 7, wherein the material in which the two discontinuous stiffeners are encased is coupled to the inner side of the outer layer.

9. The upper body garment of claim 4, wherein the two discontinuous stiffeners are encased in a foamed material, and the foamed material is coupled to the outer layer.

10. The upper body garment of claim 4, wherein the central region of the inner layer further comprises a right cup and a left cup, the right cup for receiving the wearer's right breast, and the left cup for receiving the wearer's left breast, the right stiffener being disposed over an upper portion of the right cup and the left stiffener being disposed over an upper portion of the left cup when the outer layer is attached to the inner layer, the right and left stiffeners each having an arcuate shape.

11. The upper body garment of claim 1, wherein the inferior end portion of the middle extension comprises a first middle extension fastener and an intermediate portion of the middle extension comprises a second middle extension fastener, the first middle extension fastener being removably attachable to the second middle extension fastener.

12. The upper body garment of claim 1, further comprising right and left shoulder straps extending superiorly from the central region of the inner layer, wherein the right and left shoulder straps are coupled to a posterior side of the inner layer.

13. The upper body garment of claim 12, wherein the right and left shoulder straps cross over each other on the posterior side.

14. The upper body garment of claim 12, further comprising a posterior shoulder strap coupler that couples the right and left shoulder straps to each other, wherein the band of the inner layer extends to the posterior side, and the shoulder strap coupler is disposed superiorly relative to the band.

15. The upper body garment of claim 12, wherein band comprises a first posterior end and a second posterior end, the first posterior end of the band being coupled to a first back fastener and the second posterior end of the band being coupled to a second back fastener, wherein the back fasteners are attachable together.

16. The upper body garment of claim 15, wherein the first posterior end and the first back fastener are coupled by a first elastic material extending therebetween, and the second posterior end and the second back fastener are coupled by a second elastic material extending therebetween, the first and second elastic materials having an elasticity that is greater than an elasticity of the band.

17. The upper body garment of claim 1, wherein the right and left side extensions comprise right and left side extension fasteners for removably attaching the right and left side extensions to the inner layer.

* * * * *